US010951995B2

(12) United States Patent
Bramsløw

(10) Patent No.: US 10,951,995 B2
(45) Date of Patent: Mar. 16, 2021

(54) BINAURAL LEVEL AND/OR GAIN ESTIMATOR AND A HEARING SYSTEM COMPRISING A BINAURAL LEVEL AND/OR GAIN ESTIMATOR

(71) Applicant: Oticon A/S, Smørum (DK)

(72) Inventor: Lars Bramsløw, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/415,174

(22) Filed: May 17, 2019

(65) Prior Publication Data

US 2019/0281395 A1 Sep. 12, 2019

Related U.S. Application Data

(62) Division of application No. 15/946,022, filed on Apr. 5, 2018, now Pat. No. 10,362,416.

(30) Foreign Application Priority Data

Apr. 6, 2017 (EP) ..... 17165261

(51) Int. Cl.
*H04R 25/00* (2006.01)

(52) U.S. Cl.
CPC ..... *H04R 25/505* (2013.01); *H04R 25/356* (2013.01); *H04R 25/552* (2013.01); *H04R 25/554* (2013.01); *H04R 25/407* (2013.01); *H04R 25/43* (2013.01); *H04R 2225/43* (2013.01); *H04R 2225/55* (2013.01); *H04S 2420/01* (2013.01)

(58) Field of Classification Search
None
See application file for complete search history.

(56) References Cited

U.S. PATENT DOCUMENTS

2004/0057591 A1 3/2004 Beck et al.
2004/0190734 A1 9/2004 Kates
(Continued)

FOREIGN PATENT DOCUMENTS

EP 2 445 231 4/2012
WO WO 03/081947 A1 10/2003

*Primary Examiner* — Antim G Shah
(74) *Attorney, Agent, or Firm* — Birch, Stewart, Kolasch & Birch, LLP

(57) ABSTRACT

A binaural hearing system comprises A) left and right hearing devices, each comprising a1) an input unit providing an electric input signal representing sound; and a2) an output unit, B) a binaural level and/or gain estimator comprising b1) left and right level estimators, each comprising respective fast and slow level estimators configured to provide respective fast and slow level estimates of respective electric input signals, b2) a fast binaural level comparison unit receiving the fast level estimates of the respective left and right fast level estimators and providing a fast binaural level comparison estimate; and b3) a fast binaural level and/or gain enhancer providing respective left and right binaural level and/or gain modification estimates, in dependence of said fast binaural level comparison estimate at said left and right ears, respectively, of the user. The binaural hearing system provides that the interaural level cues are either compressed, maintained or enhanced independent of each other.

13 Claims, 14 Drawing Sheets

(56) References Cited

U.S. PATENT DOCUMENTS

| | | | | |
|---|---|---|---|---|
| 2008/0253593 | A1* | 10/2008 | Bramslow | H03G 9/025 381/312 |
| 2011/0013794 | A1* | 1/2011 | Hau | H04R 25/356 381/321 |
| 2011/0249823 | A1 | 10/2011 | Thomsen et al. | |
| 2013/0010973 | A1 | 1/2013 | Ma | |
| 2015/0289065 | A1 | 10/2015 | Jensen et al. | |

* cited by examiner

BINAURAL LEVEL AND/OR GAIN ESTIMATOR AND A HEARING SYSTEM COMPRISING A BINAURAL LEVEL AND/OR GAIN ESTIMATOR

CROSS-REFERENCE TO RELATED APPLICATIONS

This application is a Divisional of copending application Ser. No. 15/946,022, filed on Apr. 5, 2018, which claims priority under 35 U.S.C. § 119(a) to Application No. 17165261.3, filed in the European Patent Office on Apr. 6, 2017, all of which are hereby expressly incorporated by reference into the present application.

SUMMARY

The present disclosure deals with level estimation in hearing systems, e.g. in relation to compressive amplification, specifically with binaural hearing systems comprising left and right hearing devices, e.g. hearing aids. The present disclosure relates in particular to binaural level estimation in such systems (where 'binaural level estimation' indicates that level estimates at one ear are or may be influenced by level estimates at the other ear).

A binaural Hearing System:

Speech understanding in background noise is still one of the main complaints from hearing aid users. Although modern hearing aids provide proper audibility in all environments, the hearing aid does not help the user much in separating talkers in front of the user from each other. Furthermore, if the targets are in the frontal plane, directional hearing aids do not offer any benefit as they supress sources from the back.

In a spatial listening scenario, the talkers are at different angles seen from the viewpoint of the listener (see e.g. sound sources S1($\theta_1$), S2($\theta_1$) and user U, respectively in FIG. 1).

To resolve this situation, and understand one or the other of the two talkers, the listener has to segregate the two speech streams ($s_1(n)$, $s_2(n)$ in FIG. 1, n representing time). This is a complex process which normally hearing people can perform very well. When people suffer from a hearing loss, this situation becomes much harder. The reasons for this are manifold. First, the localization ability drops significantly as people with hearing loss have poorer use of the interaural time difference (ITD) cues, and the interaural level difference (ILD) cues. Second, the frequency selectivity reduces with hearing loss. Third, for older people, the general cognitive decline sets in, by concepts as synaptopathy, and reduced short-term memory. All this results in major problems segregating sounds into resolvable and intelligible streams. The present disclosure aims at aiding this problem. The goal is to let sounds from the right side being presented mainly to the right ear and sounds from the left side to be presented mainly to the left ear. In other words, the cross-talk should be significantly reduced. The idea is that it should become significantly easier to focus on one talker if that talker is presented relatively clearly to one ear, whereas other distracting sounds are presented to the other ear. However, it does not isolate you from your surroundings, as it would be a possibility to simply change attention to the other ear, to 'eavesdrop' on what is going on in other conversations around you.

An object of the present disclosure is to increase the ability to listen in background noise, and/or to increase the ability to separate sound sources, e.g. by increasing the interaural level difference. This is e.g. realized by subtracting level estimates obtained at one ear, from the signal presented to the opposite ear. Thus, signals arriving from the right will be emphasized in the right ear and suppressed in the left, and vice versa, thus creating an enlarged better ear effect. Aside from audibility and separation, this could also potentially lead to better horizontal localization.

The proposed solution basically increases the hearing device gain (increases the signal) in a frequency band, whenever there is lower energy present in the similar frequency band on the opposite ear/device. Thus, sounds coming from the right will be reduced on the left ear, creating a much enhanced ILD (and vice versa). In an embodiment, relatively fast level differences in a frequency hand (e.g. detected by level estimators with fast (low) attack/release time constants) between the left and right hearing devices are amplified, while relatively slow level differences in a frequency band (e.g. detected by level estimators with slow (high) attack/release time constants) between the left and right hearing devices are left unchanged.

Two signal sources, e.g. representing respective talkers S1, S2, each providing a separate speech stream (cf. $s_1(n)$, $s_2(n)$ in FIG. 1) are assumed to exhibit time segments, where one of them dominates over the other allowing binaural level modification estimates to be determined for each of the streams separately and thus enhancing both streams.

It should be noted that the binaural level modifications proposed in the present disclosure are focused on changes due to changes in modulation, not due to spatial movement. The modulation changes are fast events important for segregation while the movements are slower events important for localisation.

The binaural modifications of level and gain referred to in the present disclosure are modifications compared to corresponding monaural values. The binaural modifications may be considered as modifications (induced by binaural considerations) of level and gain applied (or otherwise used) in a given hearing device at a given ear over the values of level and gain determined solely based on local values (e.g. of sound pressure level at the ear in question).

In an aspect of the present application, a binaural hearing system is provided by the present disclosure. The binaural hearing system comprises

- a left and right hearing devices, e.g. hearing aids, adapted for being worn at or in left and right ears, respectively, of a user, or for being fully or partially implanted in the head at the left and right ears, respectively, of the user.

Each of the left and right hearing devices comprises

- an input unit for providing respective electric input signals representing sound from the environment at said left and right ears of the user;
- an output unit for providing respective output stimuli perceivable by the user and representative of said sound from the environment based on processed versions of said electric input signals;
- a binaural level and/or gain estimator for providing left and right binaural level modification estimates and/or left and right binaural gain modification estimates.

The binaural level and/or gain estimator comprises left and right level estimators, each comprising

- a fast level estimator configured to provide a fast level estimate of the electric input signal,
- a slow level estimator configured to provide a slow level estimate of the electric input wherein attack and/or release times of said slow level estimator is/are larger than attack and/or release times of said fast level estimator a fast binaural level comparison unit receiving the fast level estimates of the respective left and right fast level estimators and providing a fast binaural level comparison estimate; and a fast binaural level and/or gain enhancer providing respective left and right binaural level and/or gain modification estimates, in dependence of said fast binaural level comparison estimate at said left and right ears, respectively, of the user.

Thereby an improved binaural hearing system is provided.

It is an object of the disclosure to enhance fast attacks (e.g. fast level changes) on both sides in order to present best possible fast interaural time cues, e.g. interaural temporal envelope differences (ITED) (e.g. at lower frequencies, e.g. below 1.5 kHz), for improving segregation of multiple talkers in the auditory space. It is a further object to handle fast interaural cues such as short speech segments coming from either side:

The left and right binaural level and/or gain modification estimates at a given hearing device are determined as a (possibly frequency dependent) function $f$ of the fast binaural level comparison estimate (ΔFLEi), BL/GMEi(k)=$f$(ΔFLEi(k)), i=1, 2 is a hearing aid index (left, right) and k=1, . . . , K is a frequency index. In general, the fast binaural level and/or gain enhancer can be configured to attenuate, restore or amplify the binaural cues as desired according an audiological concept, and/or the user's hearing ability. In general, the function $f$ is different from a unity function, at least at one or more (e.g. a majority or all) frequencies.

In an embodiment, left and right fast binaural level comparison estimates are determined by comparing the values of the left and right level estimates directly, or by comparing functional values (e.g. logarithmic and/or absolute, and/or absolute squared values) of the left and right level estimates. In an embodiment, ΔFLE(1,2)=FLE1/FLE2, and ΔFLE(2,1)=FLE2/FLE1=1/ΔFLE(1,2). In an embodiment, ΔFLE(1,2)=α(log (FLE1)−log(FLE2)), and ΔFLE(2,1)=Δ(log (FLE2)−log(FLE1))=−ΔFLE(1,2), where α is a (e.g. real) constant, and log is a logarithmic function. In the latter case appropriate linear to logarithmic and logarithmic to linear conversion units are included as needed. In an embodiment, ΔFLE(1,2)=20 $\log_{10}$(FLE1)−20 $\log_{10}$(FLE2) [dB], and ΔFLE(2,1)=20 $\log_{10}$(FLE2)−20 $\log_{10}$(FLE1) [dB]=−ΔFLE(1,2).

In an embodiment, left and right fast binaural level comparison estimates are determined as the algebraic ratios between the fast level estimates of the left and right fast level estimators, where e.g. FLE1 and FLE2 represent (linear) values of the respective level estimates. In an embodiment, left and right fast binaural level comparison estimates (ΔFLE1, ΔFLE2) are determined as the algebraic differences ΔFLE between the fast level estimates (FLE1', FLE2') of the left and right fast level estimators (FLD1, FLD2) (calculated with operational sign), where e.g. FLE1' and FLE2' represent logarithmic values of the respective level estimates.

In an embodiment, the fast binaural level comparison unit, and the fast binaural level and/or gain enhancer are operationally connected and form part of a binaural level control unit receiving the left and right fast level estimates, and providing the left and right binaural level and/or gain modification estimates.

In an embodiment, the fast binaural level and/or gain enhancer is configured to provide the respective left and right binaural level and/or gain modification estimates, in dependence of amplified versions of the fast binaural level comparison estimate at the left and right ears, respectively, of the user. In an embodiment, 'providing respective left and right binaural level modification estimates in dependence of the fast level estimates of the respective left and right level estimators' is taken to mean providing that for each of the left and right electric input signals of the left and right hearing devices, a positive level difference determined based on the fast level estimates is made more positive (providing a larger resulting estimated level or gain), and a negative level difference determined based on the fast level estimates is made more negative (providing a smaller resulting level or gain) in or to the hearing device in question. In an embodiment, the respective left and right binaural level or gain modification estimates are determined by amplifying differences between the fast level estimates of the left and right fast level estimators, providing the left binaural level modification estimate (BLME1), and between the fast level estimates of the right and left fast level estimators, providing the right binaural level modification estimate (BLME2).

In an embodiment, the hearing system is configured to amplify fast level differences between the left and right hearing devices, while leaving slow level differences between the left and right hearing devices unchanged.

In an embodiment, the binaural hearing system comprises a resulting level and/or gain estimator (e.g. embodied as left and right resulting level and/or gain estimation units) configured to provide respective resulting left and right level estimates and/or resulting left and right gains, respectively, in dependence of the left and right binaural level and/or gain modification estimates, and respective left and right input level estimates of the electric input signals.

In an embodiment, the respective left and right input level estimates of the electric input signals is constituted by or comprises the respective slow level estimates of the electric input signals. The left and right input level estimates may e.g. refer to the (left and right) fast and slow level estimates according to the present disclosure (e.g. FLE1, SLE1 and FLE2, SLE2 in FIG. 3A).

In an embodiment, left and right resulting level and/or gain estimation unit(s) is/are configured to provide the resulting left and right level estimates and/or the resulting left and right gains, respectively, in dependence of the left and right binaural level modification estimates and the left and right input level estimates, respectively. In an embodiment, the resulting left and right level estimates are determined as an algebraic sum of the binaural level modification estimates and the left and right input level estimates (e.g. the left and right slow level estimates), respectively. In an embodiment, the left and right resulting level and/or gain estimation units comprises respective level to gain converters for providing resulting gains based on the resulting left and right level estimates.

In an embodiment, each of the left and right resulting level and/or gain estimation units comprises A compressive amplification unit for determining a main gain from a compressive amplification algorithm in dependence of the respective left and right slow level estimates;

A combination unit for providing the resulting left and right gains as a combination of the respective main gains and the respective binaural gain modification estimates (for the respective left and right hearing devices, cf. e.g. FIG. 5).

In an embodiment, the combination unit comprises a sum unit (cf (GCU1, GCU2) in FIG. 5). In an embodiment, the resulting left and right gains are foamed as a sum of the main gains and the binaural gain modification estimates, respectively (cf. e.g. sum units '+' (GCU1, GCU2) in FIG. 5). In an embodiment, the compressive amplification algorithm is adapted to the user's hearing ability, e.g. to a hearing impairment of the user.

In an embodiment, the binaural hearing system comprises respective combination units for applying the resulting left and right gains to the left and right electric input signals, respectively, or to signals derived therefrom. In an embodiment, the binaural hearing system, e.g. each of the left and right hearing devices, comprises a combination unit for applying the resulting left and right gains to the left and right electric input signals, respectively. In an embodiment, the combination unit comprises a multiplication unit (cf. e.g. 'X' (cf. CU1, CU2) in FIG. 5). In an embodiment, the binaural hearing system comprises linear to logarithmic conversion units or logarithmic to linear conversion units as appropriate, e.g. for simplifying processing of the binaural hearing system.

In an embodiment, the binaural level and/or gain estimator further comprises a slow binaural level comparison unit configured to receive the slow level estimates of the respective left and right slow level estimators and providing a slow binaural level comparison estimate; and a slow binaural level enhancer providing respective left and right binaural level (and/or gain) modification estimates in dependence of the slow binaural level comparison estimate. In an embodiment, the binaural level and/or gain estimator (BLGD), e.g. the respective left and right level estimators (LD1, LD2), is(are) configured to provide the left and right binaural level modification estimates (BLME11, BLME12, BLME21, BLME22) in dependence of the fast level estimates as well as of the slow level estimates (FLE1, SLE1), (FLE2, SLE2)) of the respective left and right level estimators (LD1, LD2), cf. e.g. FIG. 4B. In an embodiment, fast left and right binaural level comparison estimates (ΔFLE1, ΔFLE2) are determined as the algebraic ratios or differences ΔFLE between the fast level estimates (FLE1, FLE2) of the left and right fast level estimators (or logarithmic values of the respective level estimates). For the left hearing device (=HD1 in the drawings), ΔFLE1=FLE1−FLE2, and for the right hearing device (=HD2 in the drawings) ΔFLE2=FLE2−FLE1=−ΔFLE1. Correspondingly, in an embodiment, slow left and right binaural level comparison estimates (ΔSLE1, ΔSLE2) are determined as the algebraic ratios or differences ΔSLE between the slow level estimates (SLE1, SLE2) of the left and right slow level estimators (SLD1, SLD2) (or logarithmic values of the respective level estimates). For the left hearing device, ΔSLE1=SLE1−SLE2, and for the right hearing device, ΔSLE2=SLE2−SLE1=−ΔSLE1.

In an embodiment, the left and right slow level estimators are configurable in that the attack and/or release times of the slow level estimators are controllable in dependence of a respective control signal. In an embodiment, the respective control signals depend on the first left and right binaural level modification estimates and/or on a difference between the respective fast and slow level estimates of the respective left and right level estimators.

In an embodiment, the configurable level estimator comprises a level estimator as described in WO2003081947A1 (cf. also FIG. 7A, 7B). In an embodiment, the level estimator as described in WO2003081947A1 is modified to include a binaural level modification estimate according to the present disclosure as a control input (cf optional dashed input signal BLMEx1 in FIG. 7A).

In an embodiment, each of the left and right hearing devices comprises respective antenna and transceiver circuitry to provide that information signals, including the level estimates and/or the gain estimates, and/or the electric input signals, or signals derived therefrom, can be exchanged between the left and right hearing devices and/or between the left and right hearing devices and an auxiliary device. The level estimates that can be exchanged may e.g. include some or all of the left and right, slow and fast level estimates. The electric input signals (or parts thereof, e.g. selected frequency bands) that can be exchanged may e.g. include some or all of the electric input signals (or signals derived therefrom) of the left and right hearing devices.

In an embodiment, the input units of the left and right hearing devices each comprises a time domain to time-frequency domain conversion unit, e.g. an analysis filter bank, for providing the respective electric input in a time-frequency representation as frequency sub-hand signals in a number K of frequency sub-bands. In an embodiment, the left and right level estimators are configured to determine the fast and slow level estimates in a number of frequency sub-bands Kx, where Kx is smaller than or equal to K(Kx≤K). In an embodiment, the resulting level estimates and/or the resulting gains are determined on a frequency sub-band level (e.g. in Kx or K sub-bands). In an embodiment, the binaural hearing system comprises appropriate band conversion units (e.g. from K to Kx bands (e.g. band-sum unit(s)) and/or from Kx to K bands (band distribution unit(s)), K≥Kx).

In an embodiment, the resulting level estimate in a given frequency sub-band RLEi(k), k being a frequency sub-band index (k=1, . . . , K or Kx, where K (or Kx) is the number of frequency sub-bands, where the level is (individually) estimated), of a given hearing device HDi, i=1 (left), 2 (right), is determined as a first estimated level LEi(k), e.g. the slow level estimate SLEi, of the electric input signal of hearing device HDi plus a level difference BLMEi(k) i=1, 2, which is a function $f$ of an estimated level difference ΔLEi(k) between second level estimates LEi'(k), e.g. the fast level estimates (FLEi, i=1, 2), of the two hearing devices (e.g. ΔLE1(*k*)=ΔFLE1(*k*)=FLE1(*k*)−FLE2(*k*), and ΔLE2(*k*)=ΔFLE2(*k*)=FLE2(*k*)−FLE1(*k*)). In other words, RLEi(k)=SLEi(k)+BLMEi(k), where BLMEi(k)=$f$(ΔFLEi(k)), i=1, 2. According to and embodiment of the present disclosure, BLMEi(k)>ΔFLEi(k) for ΔFLEi(k)>0, and BLMEi(k)<ΔFLEi(k) for ΔFLEi(k)<0, at least for some frequency bands, such as for a majority or all bands. In an embodiment, only bands above a lower threshold frequency are considered in the binaural level modification. In an embodiment, the lower threshold frequency $f_{TH1}$, is equal to 1.5 kHz, because ILD cues from the head shadow are only present above approximately 1.5 kHz.

In an embodiment, the output units of the left and right hearing devices each comprises a time-frequency domain to time domain conversion unit, e.g. a synthesis filter bank, for converting respective frequency sub-band output signals to an output signal in the time domain.

In an embodiment, the binaural hearing system, e.g. each of the left and right hearing devices, comprises a signal processor for applying one or more signal processing algorithms to the electric input signals or to respective processed versions of the electric input signals. In an embodiment, the signal processing unit(s) comprise(s) the combination units for applying the resulting left and right gains to the left and right electric input signals, respectively, or to processed versions thereof.

In an embodiment, the binaural hearing system comprises an auxiliary device configured to allow the exchange of data with the left and right hearing devices. In an embodiment, the left and right hearing devices comprises only input and output units and an appropriate wired or wireless interface to the processing unit, e.g. embodied in an auxiliary device. In an embodiment, the auxiliary device comprises the binaural level and/or gain estimator.

In an embodiment, (each of) the left and right hearing devices constitutes or comprises a hearing aid, a headset, an earphone, an ear protection device or a combination thereof.

In an embodiment, the binaural hearing system comprises an auxiliary device, e.g. a remote control, a smartphone, or other portable or wearable electronic device, such as a smartwatch or the like.

In an embodiment, the binaural hearing system is adapted to establish a communication link between the hearing device(s) and the auxiliary device to provide that information (e.g. control and status signals (including level estimates or data related to level estimates), and possibly audio signals) can be exchanged or forwarded from one to the other.

In an embodiment, the auxiliary device is or comprises a smartphone or similar communication device. In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In the present context, a SmartPhone, may comprise

- a (A) cellular telephone comprising a microphone, a speaker, and a interface to the public switched telephone network (PSTN) COMBINED with
- a (B) personal computer comprising a processor, a memory, an operative system (OS), a user interface (e.g. a keyboard and display, e.g. integrated in a touch sensitive display) and a wireless data interface (including a Web-browser), allowing a user to download and execute application programs (APPS) implementing specific functional features (e.g. displaying information retrieved from the Internet, remotely controlling another device (e.g. a hearing device), combining information from various sensors of the smartphone (e.g. camera, scanner, GPS, microphone, accelerometer, gyroscope, etc.) and/or external sensors to provide special features, etc.).

A Hearing Device:

In an embodiment, the hearing device is adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the hearing device comprises a signal processor for enhancing the input signals and providing a processed output signal.

The hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

The hearing device comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing the sound. In an embodiment, the hearing device comprises a directional microphone system adapted to spatially filter sounds from the environment, and thereby enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art.

In an embodiment, the hearing device comprises an antenna and transceiver circuitry for wirelessly receiving a direct electric input signal from another device, e.g. a communication device or another hearing device. In an embodiment, the hearing device comprises a (possibly standardized) electric interface (e.g. in the form of a connector) for receiving a wired direct electric input signal from another device, e.g. a communication device or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by a transmitter and antenna and transceiver circuitry of the hearing device can be of any type. In an embodiment, the wireless link is used under power constraints, e.g. in that the hearing device comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying), e.g. MSK (minimum shift keying), or QAM (quadrature amplitude modulation).

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device is portable device, e.g. a device comprising a local energy source, e.g. a battery, e.g. rechargeable battery.

In an embodiment, the hearing device comprises a forward or signal path between the input unit (e.g. comprising an input transducer (e.g. microphone system and/or direct electric input (e.g. a wireless receiver))) and the output unit (e.g. comprising an output transducer). In an embodiment, a signal processor is located in the forward path. In an embodiment, the signal processor is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, sonic or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at to by a predefined number $N_b$, of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively, or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain).

In a particular embodiment, the hearing device comprises a voice activity detector (VAD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. noise, such as artificially generated noise), thereby allowing an estimate of a noise level to be provided during time segments classified as NO-VOICE. In an embodiment, the voice detector is adapted to detect as a VOICE also the user's own voice. Alternatively, the voice detector is adapted to exclude a user's own voice from the detection of a VOICE. In an embodiment, the hearing device comprises an own voice detector for estimating whether or not (or with what probability) a given input sound (e.g. a voice, e.g. speech) originates from the voice of the user of the hearing system.

In an embodiment, the hearing device further comprises other relevant functionality for the application in question, e.g. compression, noise reduction, feedback estimation/cancellation, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

A Binaural Level and/or Gain Estimator:

In an aspect, a binaural level and/or gain estimator for providing left and right binaural level modification estimates and/or left and right binaural gain modification estimates is furthermore provided. The binaural level and/or gain estimator comprises

- a left and right level estimators, each comprising
  - a fast level estimator configured to provide a fast level estimate of the electric input signal,
  - a slow level estimator configured to provide a slow level estimate of the electric input signal, wherein attack and/or release times of the slow level estimator is/are larger than attack and/or release times of the fast level estimator. The binaural level and/or gain estimator further comprises

- a fast binaural level comparison unit receiving the fast level estimates of the respective left and right fast level estimators and providing a fast binaural level comparison estimate; and
- a fast binaural level and/or gain enhancer providing respective left and right binaural level and/or gain modification estimates, in dependence of the fast binaural level comparison estimate at said left and right ears, respectively, of the user.

In an embodiment, the binaural level and/or gain estimator is configured to provide separate (independent slow and fast) modification estimates in response to slow and fast level changes (estimates) of the input signals. In an embodiment, a binaural level and/or gain estimator with separate modification of slow and fast binaural cues is provided.

Use:

In an aspect, use of a hearing device as described above, in the 'detailed description of embodiments' and in the claims, is moreover provided. In an embodiment, use is provided in a system comprising audio distribution. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Method:

In an aspect, a method of estimating a level of left and right electric input signals of left and right hearing devices, e.g. hearing aids, of a binaural hearing system, the left and right hearing devices being adapted for being worn at or in left and right ears, respectively, of a user, or for being fully or partially implanted in the head at the left and right ears, respectively, of the user is furthermore provided by the present application. The method comprises

- providing respective left and right electric input signals (IN1, IN2) representing sound from the environment at the left and right hearing devices, respectively;
- providing respective left and right output stimuli perceivable by a user as representative of said sound from the environment based on processed versions of said electric input signals (IN1, IN2);
- providing respective left and right fast level estimates (FLE1, FLE2) of the electric input signals (IN1, IN2);
- providing respective left and right slow level estimates (SLE1, SLE2) of the electric input signals (IN1, IN2), wherein attack and/or release times of said slow level estimates is/are larger than attack and/or release times of said fast level estimates;
- providing a fast binaural level comparison estimate based on said respective left and right fast level estimates of the electric input signals; and
- providing respective left and right binaural level and/or gain modification estimates in dependence of sad fast binaural level comparison estimates at said left and right ears, respectively.

It is intended that some or all of the structural features of the hearing system described above, in the 'detailed description of embodiments' or in the claims can be combined with embodiments of the method, when appropriately substituted by a corresponding process and vice versa. Embodiments of the method have the same advantages as the corresponding hearing system.

In an embodiment, the method comprises providing resulting left and right level estimates of the left and right electric input signals, respectively, and/or providing resulting left and right gains for application to the left and right electric input signals in dependence of the left and right binaural level modification estimates, respectively.

In an embodiment, respective fast and slow interaural gain changes for compressing, maintaining or expanding the fast and slow interaural level cues independent of each other are provided.

In an embodiment, the respective left and right binaural level modification estimates are determined by amplifying the differences between the left and right fast level estimates thereby providing the left binaural level modification estimate, and by amplifying the differences between the right and left fast level estimates thereby providing the right binaural level modification estimate.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least sonic (such as a majority or all) of the steps of the method described above, in the 'detailed description of embodiments' and in the claims is furthermore provided by the present application.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions:

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through pails of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-home acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-car bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as hearables, such as hearing aids, earphones, active ear protection devices, etc.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1:
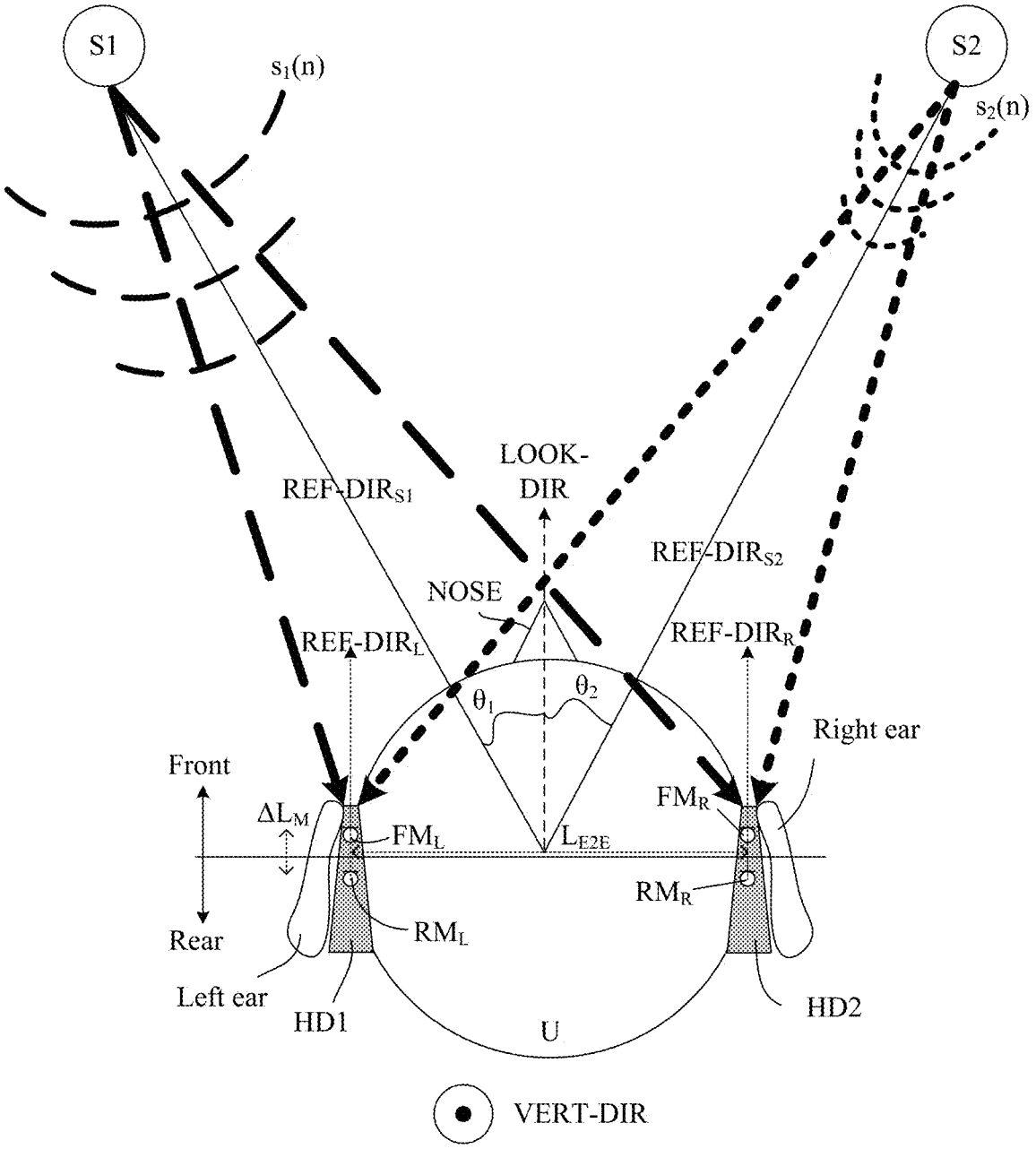
FIG. 1 shows use case of a binaural hearing system according to the present disclosure where a user is wearing the hearing system is faced towards two competing sound sources.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the ail from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules; components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids.

When listening to speech in noisy surroundings, the binaural cues provided by the two ears placed on the human head are important to be able to pick out one talker/source among a multitude of sound sources. The distance between the ears will provide an 1) interaural time difference (ITD), either directly as a phase shift in the signal for low frequencies or as a time difference in the envelope of higher frequencies and 2) an interaural level difference (ILD) at higher frequencies, due to the head shadow effect (providing frequency dependent attenuation).

These binaural cues are important for spatial perception in general, but also very important for the unmasking of competing voices, e.g. two speakers at a restaurant table. In the latter case, the ITD phase shift and the transient envelope cues have been found to be important for this 'spatial unmasking' of a given talker against a background of one or more competing voices.

For compensation of hearing loss, modern digital hearing aids employ dynamic range compression (or compressive amplification), whereby softer signals are amplified more than louder signals. The dynamic range compression uses an estimate of the current signal level to set the gain of the hearing aid in one or more frequency channels (or bands). In order to provide good sound quality and speech intelligibility, users tend to prefer slow time constants, i.e. almost linear behaviour of the instrument, but on the other hand sudden transients and loud sounds need to be dampened quickly to avoid discomfort.

Level estimation has been dealt with in numerous prior all documents. One such example is WO2003081947A1 describing an adaptive level estimator, wherein attack and/or release times are (adaptively) determined in dependence of dynamic properties of the input signal (cf. e.g. FIG. 7A, 7B). In WO2003081947A1, the level estimate is performed on a full band signal (one frequency band), but may be implemented individually in a number of frequency bands.

In relation to binaural cues, a side effect of uncoordinated compression in left and right hearing devices will reduce the ILD cues, thereby potentially degrading the unmasking cues needed in difficult situations. This problem can be handled by exchanging level estimates between the two hearing aids, e.g. 'coupled compression'. A binaural 'double compression scheme' with preservation of ILD cues is described in EP2445231A1.

FIG. 1 shows a use case of a binaural hearing system according to the present disclosure where a user (U) wearing left and right hearing devices (HD1, HD2) is faced towards two competing sound sources (S1, S2), e.g. (competing) speakers. Sound source 1 (S1) is located in the left front quarter plane relative to a look direction (LOOK-DIR) of the user and a Front-Rear delimiting vertical (cf. indication VERT-DIR in FIG. 1) plane through the user's left and right ears (Left ear, Right ear) and perpendicular to the look direction (LOOK-DIR) determined by the user's nose (NOSE), Using the same co-ordinate system, Sound source 2 (S2) is located in the right front quarter plane. Direction-of-Arrival (DoA) of sound from the two sound sources S1, S2 are indicated relative to the look direction (LOOK-DIR) as $\theta_1$ and $\theta_2$, and directions REF-DIR$_{S1}$, and REF-DIR$_{S2}$, respectively. Each of the left and right hearing devices (HD1, HD2) comprises respective front and rear microphones ($FM_L$, $RM_L$, and $FM_R$, $RM_R$, respectively). The distance between the front and rear microphones in each hearing device is indicated as $\Delta L_M$ (e.g. 8-10 mm), and the distance between the left and right hearing devices is indicated as $L_{E2E}$ being defined by the ear-to-ear-distance (e.g. 20-25 cm). Sound signals (directly) from the $1^{st}$ and $2^{nd}$ sound sources S1 and S2 are indicated by curved lines denoted $s_1(n)$ and $s_2(n)$ in FIG. 1, and their propagation to the left and right hearing devices are indicated by respective arrowed (dashed (S1) and dotted (S2)) lines in FIG. 1. The arrowed lines indicating the (direct) paths for propagation of sound from the sound sources to the hearing devices indicates (not surprisingly) that the left ear (Left ear, HD1) represents 'the better ear' for the $1^{st}$ sound source (S1) and the right ear (Right ear, HD2) represents 'the better ear' for the $2^{nd}$ sound source (S2). The better ear for a given sound source is the ear that receives sound from that sound source with a better signal to noise ratio, e.g. with a higher signal level (compared to the other ear).

The scenario of FIG. 1 anticipates that the sound sources S1, S2 are localized, ideally point sources, but in practice localized so that a direction of arrival of sound from a given sound source can be reliably detected in the hearing devices (e.g. within an estimated angle range 40 in a horizontal plane (e.g. so that REF-DIR$_{S1}$=$\theta_1$+/−$\Delta\theta$, where $\Delta\theta$ e.g. is less than or equal to 10°, or ≤5°). In an embodiment, the sound sources S1, S2 are localized to within a quarter plane relative to a look direction of the user, e.g. to front, left (0°≤θ≤90°) and right (−90°≤θ0°) quarter planes, and to back (90°≤θ≤180°) left (90°≤θ≤180°) and right (−180°≤θ≤−90°) quarter planes (or to a back half plane (90°≤θ≤270°)). The angle measures assume θ≤0°) at the look direction of the user (LOOK-DIR in FIG. 1) and positive values of θ in an anti-clockwise direction.

Figure 2A:
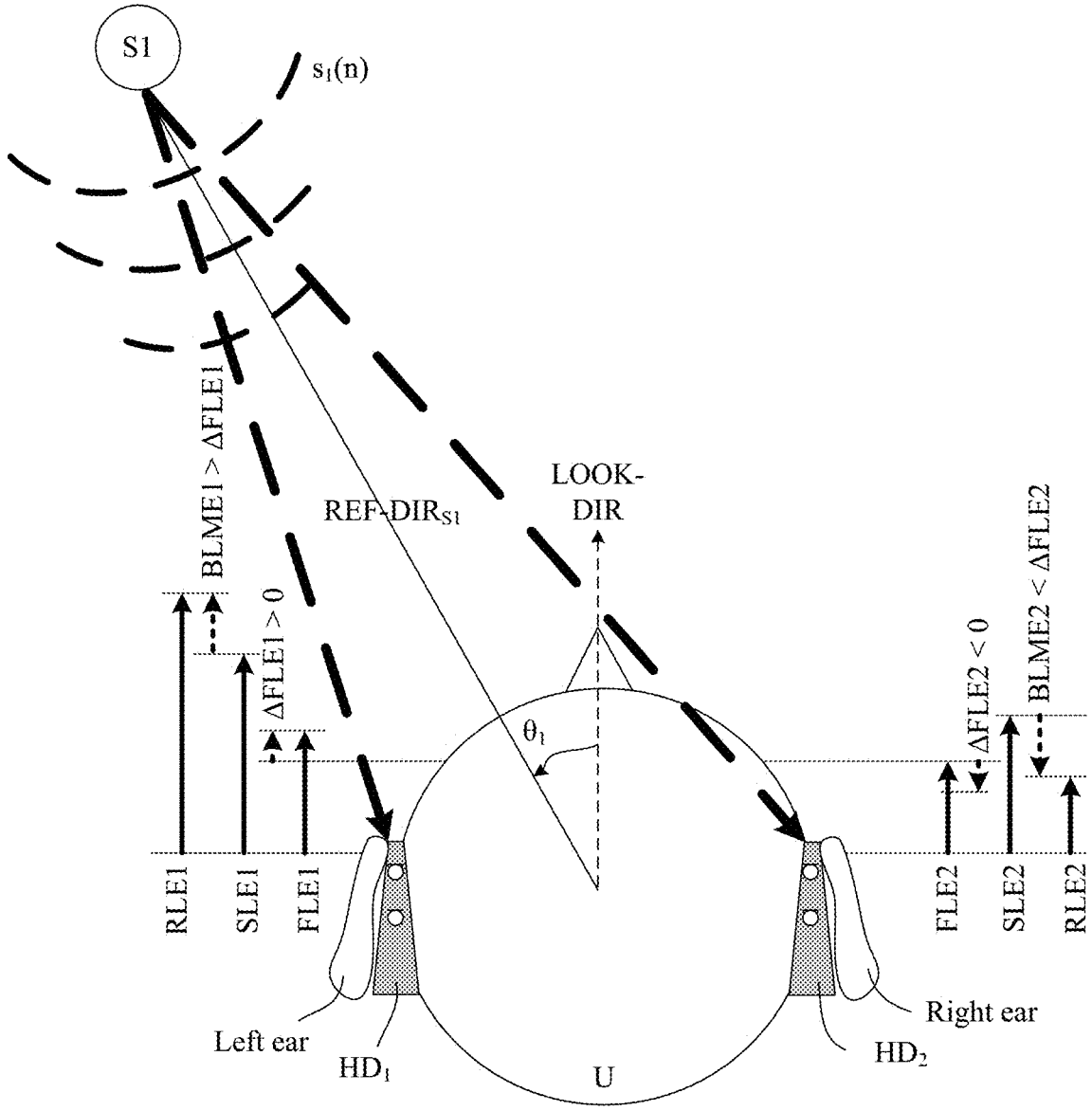
FIG. 2A illustrates the intended effect of a hearing system comprising a binaural level and/or gain estimator according an embodiment the present disclosure, wherein a sound source is located in the front left quarter plane relative to the user.
Figure 2B:
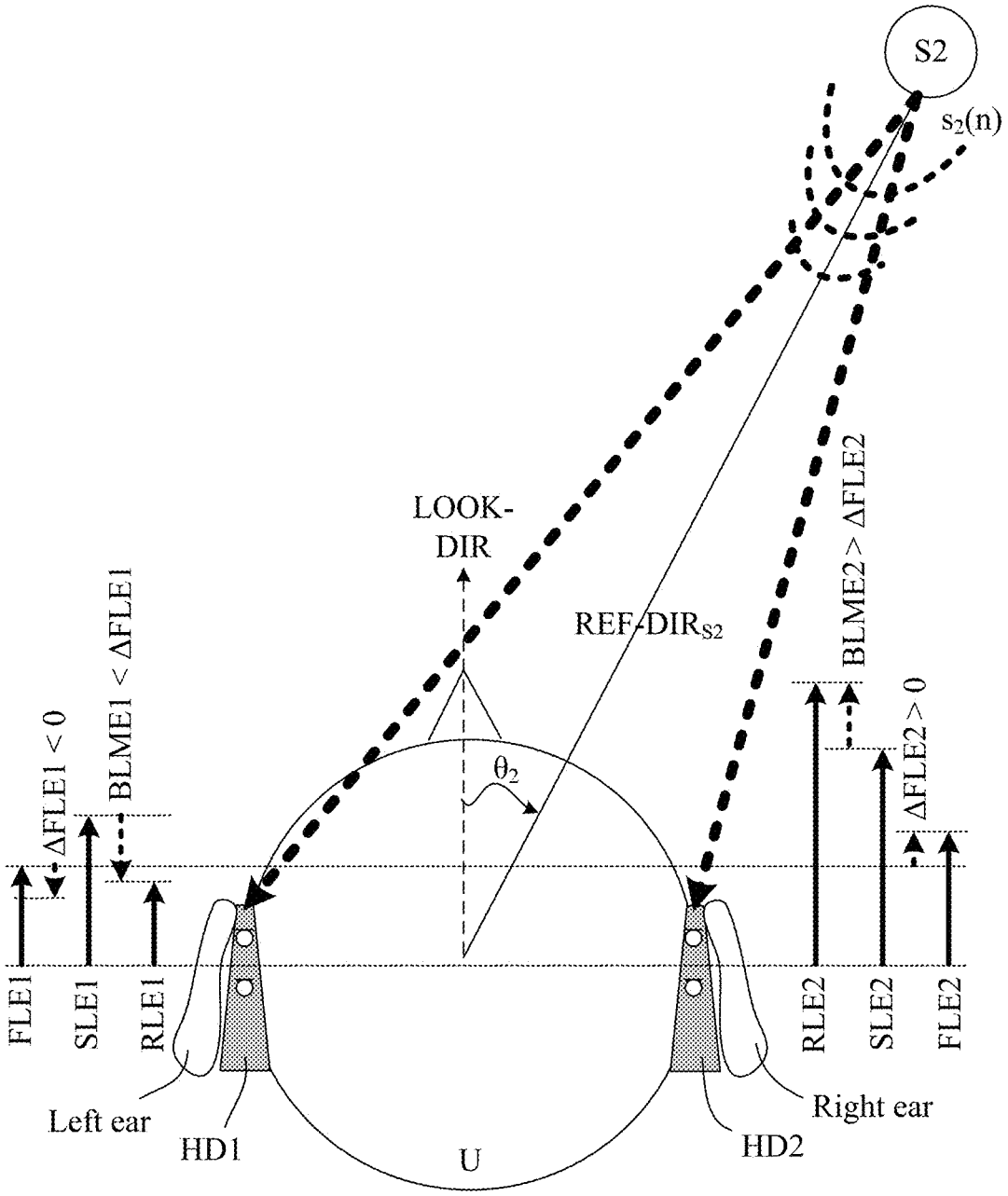
FIG. 2B correspondingly illustrates a situation as shown in FIG. 2A, but where the sound source is located in the front right quarter plane relative to the user.

To illustrate an aim of the present disclosure, the scenario of FIG. 1 is split in two separate situations in FIGS. 2A and 2B, where only one sound source is illustrated in each of the respective drawings, sound source 1 (S1) in FIG. 2A and sound source 2 (S2) in FIG. 2B.

The hearing system comprises a binaural level and/or gain estimator (BLGD in FIG. 3A) for providing resulting left and right level estimates (RLE1, RLE2) of left and right electric input signals (IN1, IN2 in FIG. 3A), respectively, as received at the left and right hearing devices (HD1, HD2), respectively. The binaural level and/or gain estimator comprises left and right level estimators (LD1, LD2 in FIG. 3A), each comprising a fast level estimator (FLD1, FLD2 in FIG. 3A) configured to provide a fast level estimate (FLE1, FLE2) of the electric input signal (IN1, IN2), and a slow level estimator (SLD1, SLD2 in FIG. 3A) configured to provide slow level estimate (SLE1, SLE2) of the electric input signal (IN1, IN2). Fast and slow is in the present context taken to mean that attack and/or release times of the slow level estimators are larger than attack and/or release times of said fast level estimators.

In an embodiment, the left and right level estimators are configured to determine the fast (FLE1, FLE2) and slow level estimates and the resulting level estimates (RLE1, RLE2) in a number of frequency sub-bands.

In general, the interaural level differences (ILD1, ILD2) used by the brain to identify a direction of arrival of sound are (in an unaided situation) represented by observed level differences between sound levels received at the left and right ears. In an embodiment, the observed ILDs are enhanced by the binaural hearing system (in that positive ILDs are made more positive, while negative ILDs are made more negative). An embodiment of such 'ILD enhancement' is illustrated in FIG. 2A, 2B.

In an embodiment, the resulting level estimate in a given frequency sub-band RLEi(k), k being a frequency sub-band index (k=1, . . . , K, where K is the number of frequency sub-bands, where the level is (individually) estimated), of a given hearing device HDi, i=1 (left), 2 (right), is determined as a first estimated level LEi(k), e.g. the slow level estimate SLEi, of the electric input signal INi of hearing device HDi plus a level difference BLMEi(k) i=1, 2, which is a function of an estimated level difference ΔLE'(k) between second level estimates LEi'(k), e.g. the fast level estimates (FLEi, i=1, 2), of the two hearing devices. In the embodiment of FIG. 2A, 2B: $\Delta LE1'(k)=\Delta FLE1(k)=FLE1(k)-FLE2(k)$, and $\Delta LE2'(k)=\Delta\Delta LE2'(k)=FLE2(k)-FLE1(k)$). In an embodiment, RLEi(k)=SLEi(k)+BLMEi(k), where BLMEi(k)=f (ΔFLEi(k)), 1=1, 2, and f is a function. According to an embodiment of the present disclosure BLMEi(k)>ΔFLEi(k) for ΔFLEi(k)>0, and BLMEi(k)<ΔFLEi(k) for ΔFLEi(k)<0.

FIG. 2A illustrates the intended effect of a hearing system comprising a binaural level and/or gain estimator according an embodiment the present disclosure, wherein a sound source (S1) is located in the front left quarter plane (0°≤θ≤90°) relative to the user (U).

FIG. 2B correspondingly illustrates a situation as shown in FIG. 2A, but where the sound source (S2) is located in the front right quarter plane (−90°≤θ≤0°) relative to the user (U).

Figure 3A:
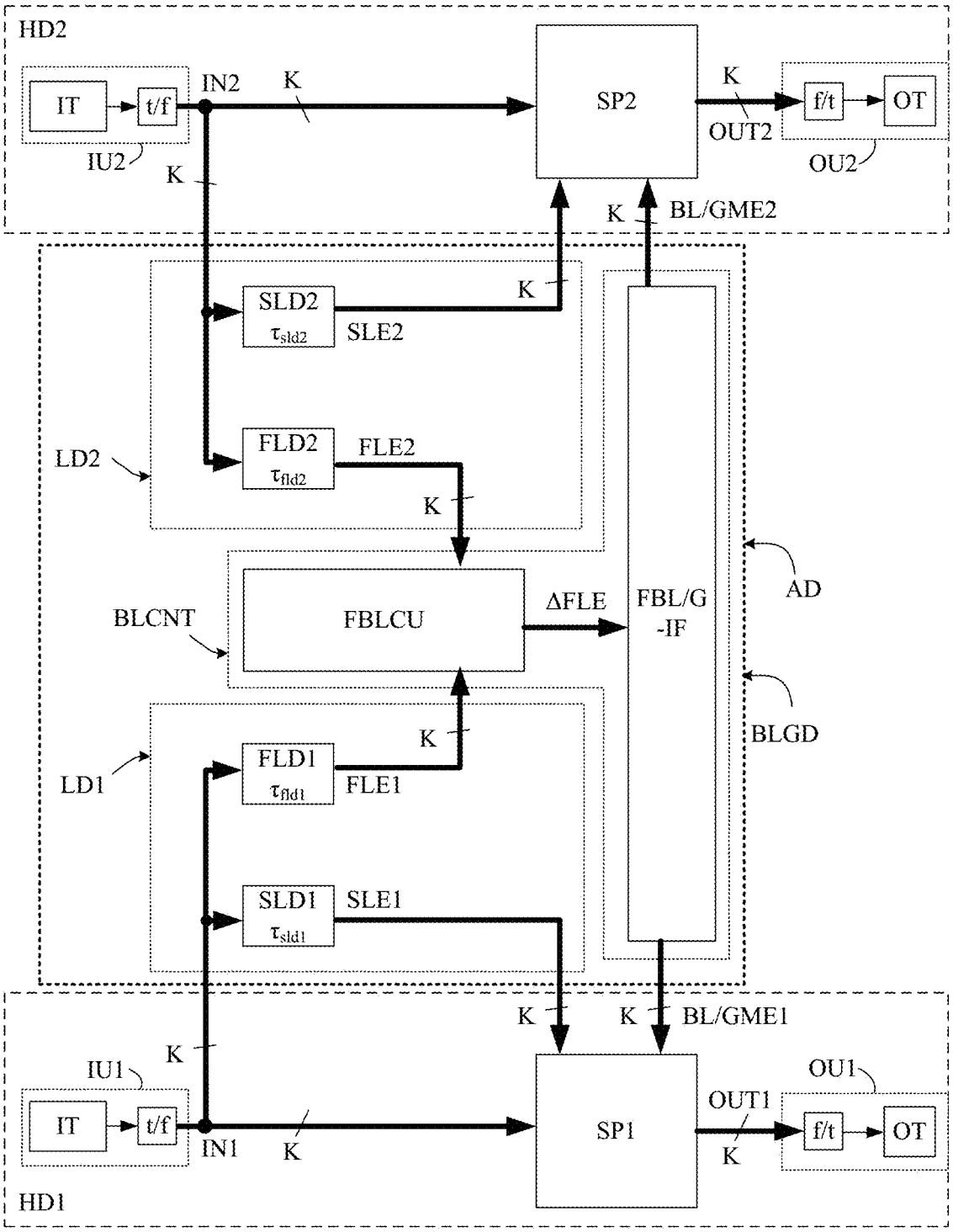
FIG. 3A shows a binaural hearing system comprising a binaural level and/or gain estimator according to a first embodiment of the present disclosure.

FIG. 3A shows a binaural hearing system comprising left and right hearing devices (HD1, HD2), and a binaural level and/or gain estimator (BLGD) according to an embodiment of the present disclosure.

The left and right hearing devices (HD1, HD2), e.g. hearing aids, are adapted for being worn at or in left and right ears, respectively, of a user, or for being fully or partially implanted in the head at the left and right ears, respectively, of the user. In an embodiment, the left and right hearing devices (HD1, HD2) are simple ear pieces comprising little more than a microphone and a loudspeaker and a connection to the binaural level and/or gain estimator. The left and right hearing devices each comprises an input unit (IU1, IU2) for providing respective electric input signals (IN1, IN2) representing sound from the environment, and respective output units (OU1, OU2) for providing respective output stimuli perceivable by a user as representative of the sound from the environment based on processed versions of the electric input signals (IN1, IN2). The left and right hearing devices are each adapted for processing an electric input signal (IN1, IN2) representing sound in a forward path, e.g. comprising a signal processor (SP1, SP2) for processing the electric input signal in a number K of frequency bands, and providing a processed signal based thereon (OUT1, OUT2). In an embodiment, a major part of, such as all, the processing of the input signals may be performed in an auxiliary device together with the binaural level and/or gain estimator (BLGD). The forward path of the left and right hearing devices (HD1, HD2) further comprises the respective output units (OU1, OU2). The respective input units 1U2) of the embodiment of FIG. 3A each comprises an input transducer (IT), e.g. a microphone, and a time to time-frequency conversion unit (t/f) for (digitizing and) converting a time domain signal to a frequency sub-band signal in K frequency sub-bands. Correspondingly, each of the respective output units (OU1, OU2) comprises a time-frequency to time conversion unit (f/t) for converting K processed frequency sub-band signals (OUT1, OUT2) to a time domain signal, and an output transducer (OT) for converting the time-domain signal to output stimuli perceivable by the user as sound.

Figure 3B:
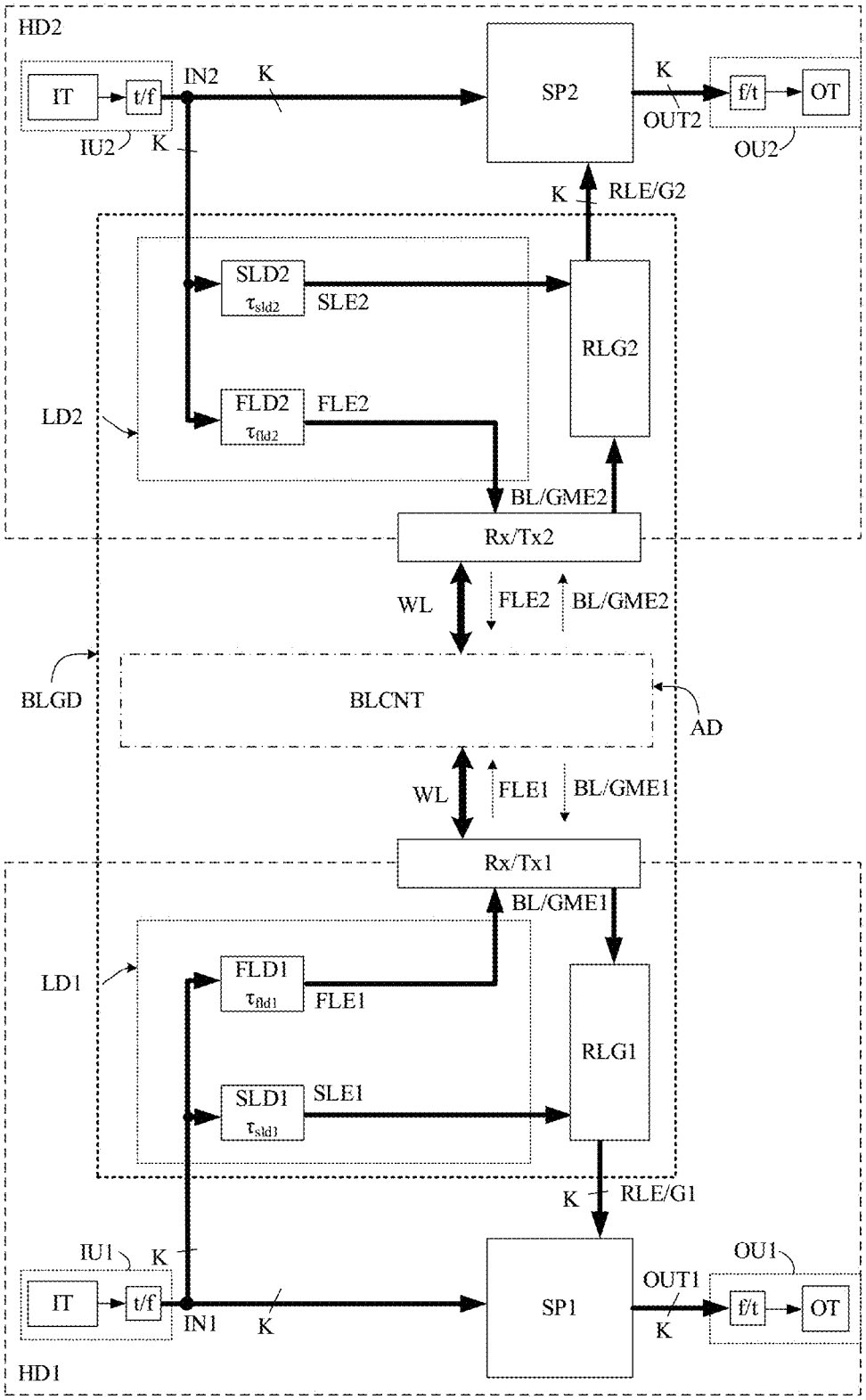
FIG. 3B shows a binaural hearing system comprising a binaural level and/or gain estimator according to a second embodiment of the present disclosure.
Figure 3C:
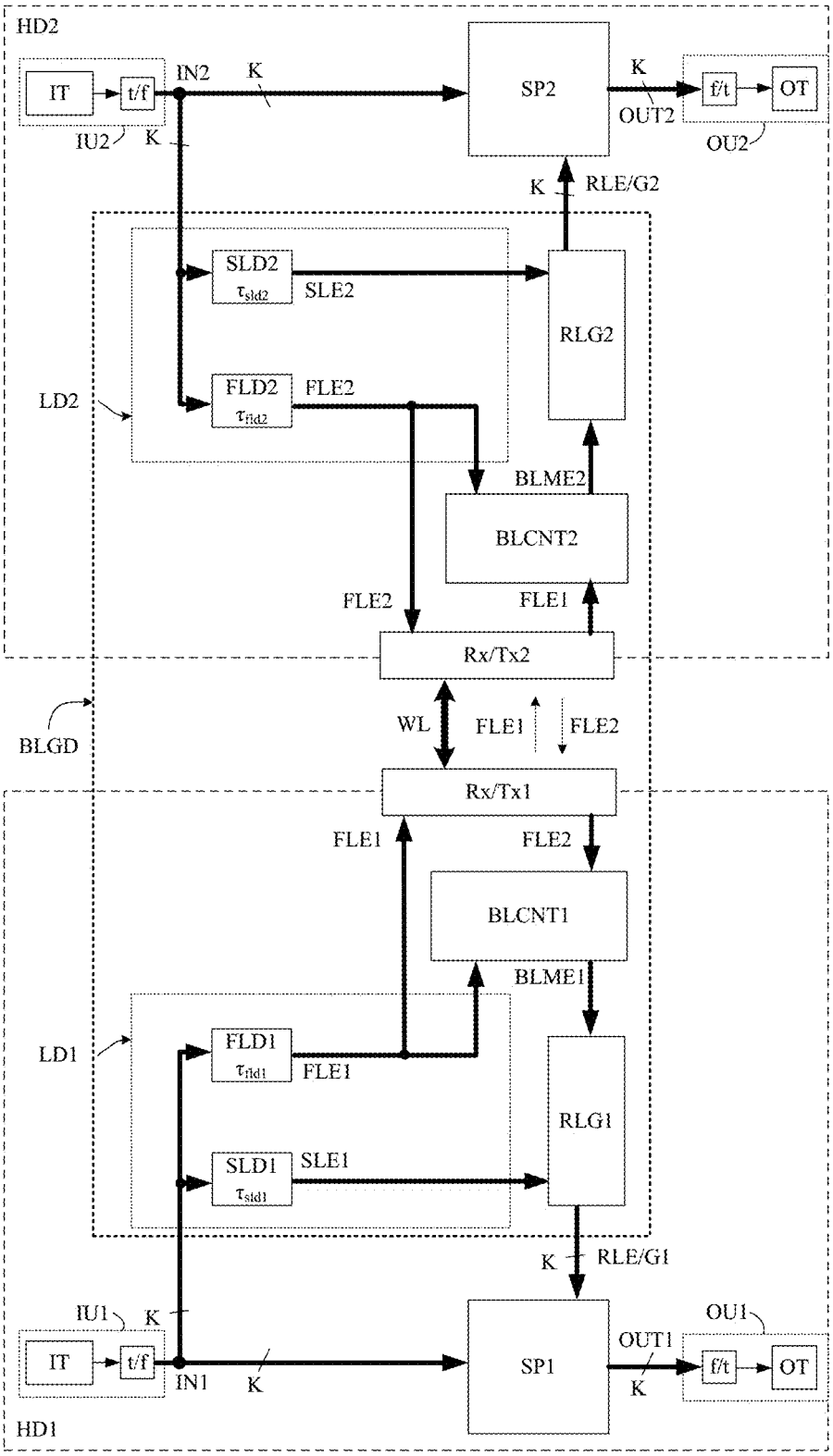
FIG. 3C shows a binaural hearing system comprising a binaural level and/or gain estimator according to a third embodiment of the present disclosure.

The binaural hearing system further comprises a binaural level and/or gain estimator (BLGD), e.g. located fully or partially in each of the left and right hearing devices (HD1, HD2), or in an auxiliary device in communication with the left and right hearing devices (cf. also FIGS. 3B and 3C). The binaural level and/or gain estimator (BLGD) comprises respective level estimators (LD1, LD2) for providing respective level estimates of the electric input signals (IN1, IN2) or signals originating therefrom. In the embodiments of FIGS. 3A, 3B, and 3C, the respective level estimators (LD1, LD2) comprises separate fast and slow level estimators (FLD1, FLD2, and SLD1, SL2, respectively) configured to provide respective fast and slow level estimates (FLE1, FLE2 and SLE1, SLE2) of the electric input signals (IN1, IN2). The attack and/or release times of the slow level estimators (SLD1, SLD2) are larger than attack and/or release times of the fast level estimators (SLD1, SLD2).

Figure 4A:
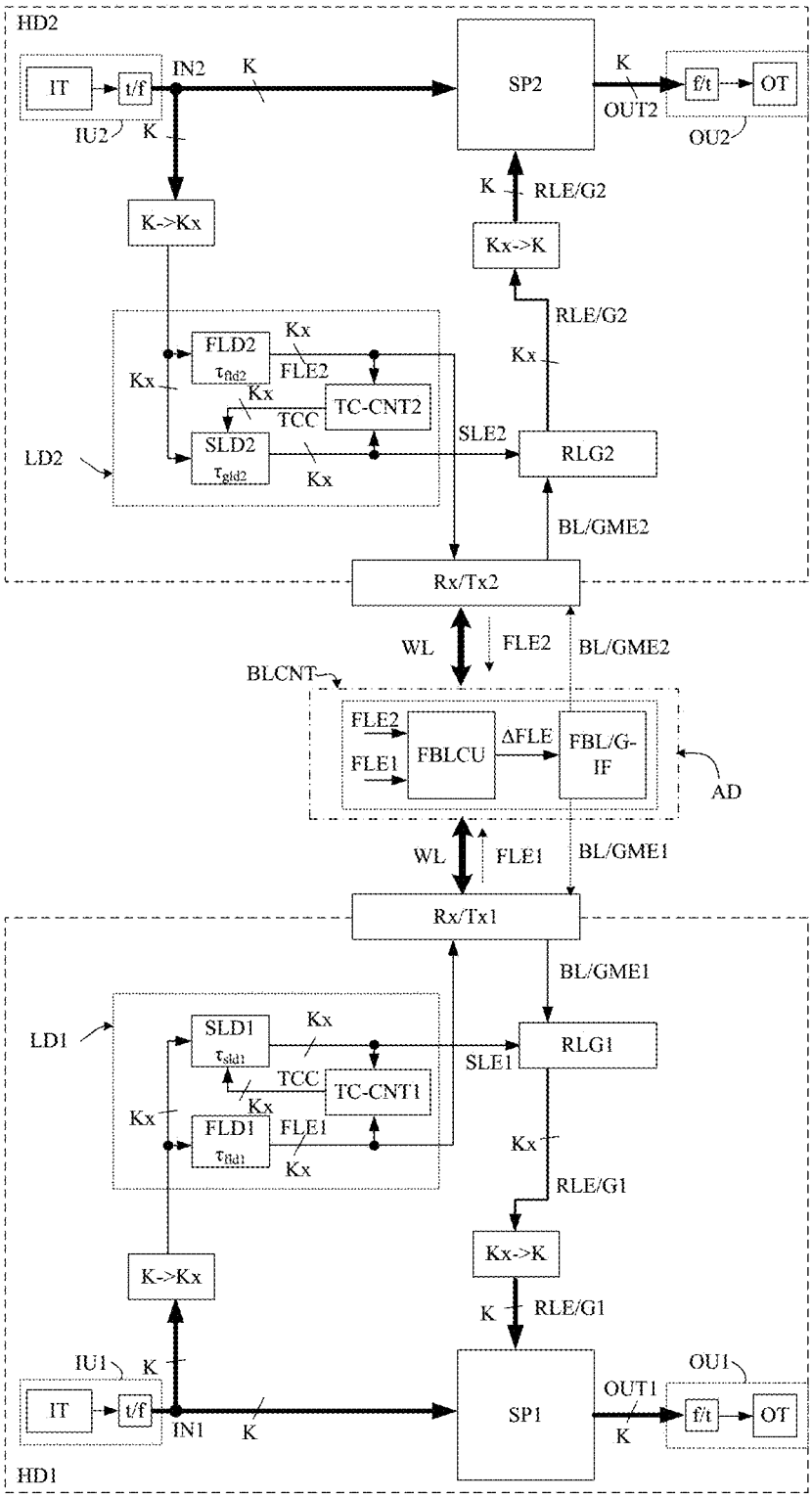
FIG. 4A shows a binaural hearing system comprising a binaural level and/or gain estimator according to a fourth embodiment of the present disclosure.
Figure 4B:
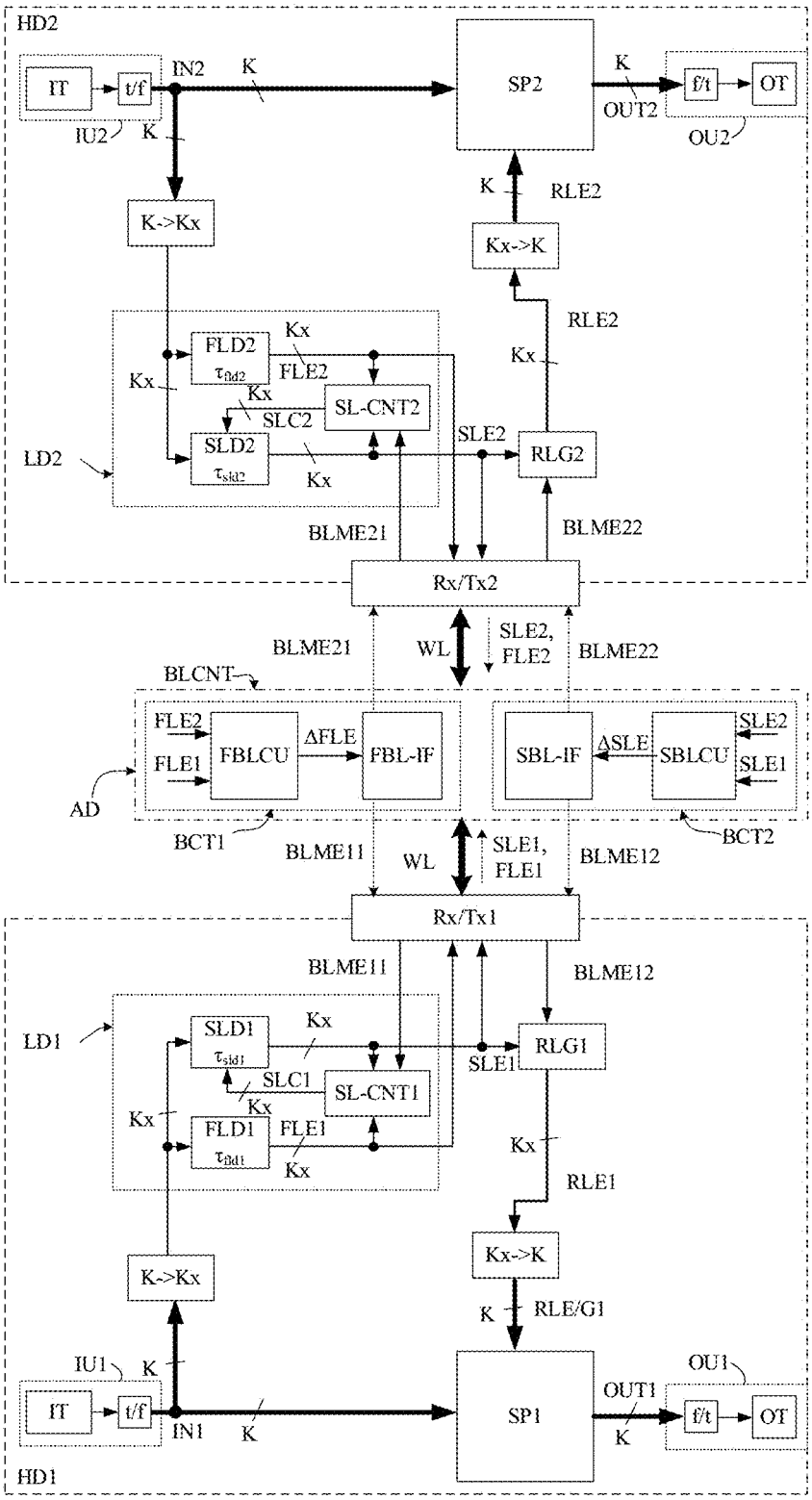
FIG. 4B shows a binaural hearing system comprising a binaural level and/or gain estimator according to a fifth embodiment of the present disclosure.

In an embodiment, the level estimators (LD1, LD2) are adapted to provide that attack and/or release time constant(s) ($\tau_{att}$, $\tau_{rel}$) used to determine the slow level estimate (SLE1, SLE2) are configurable in dependence of the electric input signals (IN1, IN2). The level estimators (LD1, LD2) may e.g. comprise the functional elements as shown in and discussed in connection with FIG. 7A, 7B. Embodiments comprising configurable level estimators (LD1, LD2) are shown in FIG. 4A, 4B.

The left and right hearing devices (HD1, HD2) and the binaural level and/or gain estimator (BLGD) may further comprise antenna and transceiver circuitry (Rx/Tx1, Rx/Tx2, etc.) configured to establish a wireless link (WL) between the left and right hearing devices to provide that information signals, e.g. including the level estimates and/or data related to attack and/or release times, can be exchanged between the left and right hearing devices (HD1, HD2) and/or between the left and right hearing devices and an auxiliary device (AD. e.g. comprising the binaural level and/or gain estimator (BLGD), cf. dotted enclosure in FIG. 3A, or e.g. comprising the binaural level control unit (BLCNT), cf. dot-dashed enclosure in FIG. 3B) depending on the practical partition of the binaural hearing system. In an embodiment, the left and right hearing devices (HD1, HD2) and the binaural level and/or gain estimator (BLED) are three separate units connected by wired or wireless links (cf. e.g. FIG. 3A). In an embodiment, the left and right hearing devices (HD1, HD2) each comprises a separate part of the binaural level and/or gain estimator (BLGD) to that the binaural hearing system comprises two separate units (HD1, HD2) connected by wired or (here) wireless links (cf. e.g. FIG. 3C).

The binaural level and/or gain estimator further comprises a binaural level control unit (BLCNT) for receiving the fast level estimates (FLE1, FLE2) of level estimators (LD1, LD2) of the left and right hearing devices (HD1, HD2). Based thereon, the binaural level control unit (BLCNT) is configured to provide binaural level and/or gain modification estimate signals (BL/GME1, BLME2) of the electric input signals (IN1, IN2) of the left and right hearing devices (HD1, HD2). The binaural control unit (BLCNT) comprises a fast binaural level comparison unit (FBLCU) for comparing respective left and right fast level estimates (FLE1, FLE2) and providing a fast comparison measure ΔFLE, e.g. an algebraic difference. The binaural control unit (BLCNT) further comprises a 'binaural influence function', here a fast binaural level and/or gain influence function (FBL/G-IF) for determining a binaural modification of the levels and/or gains at the respective ears of the user as a function of the fast comparison measure ΔFLE, e.g. the actual (estimated) fast level differences ΔFLE(i,j)=FLEi−FLEj, i, j=1,2, while i≠j (see e.g. FIG. 6A, 6B below).

The binaural level and/or modification estimate signals (BL/GME1, BL/GME2) are forwarded to the left and right hearing devices, e.g. via wireless link (WL) (or by other means, e.g. wire, depending on the partition of the system), or further processed in an auxiliary device (AD).

The binaural level and/or gain estimator (BLGD, or the left and right hearing devices (HD HD2), e.g. the respective signal processors SP1, SP2) may further comprise respective resulting level and/or gain estimation units (RLG1, RLG2) configured to provide resulting left and right level or gain estimates (RLE/G1, RLE/G2) and/or resulting left and right gains (RG1, RG2), respectively, in dependence of the left and right binaural level and/or gain modification estimates (BL/GME1, BL/GME2), respectively. In the embodiment of FIG. 3A, the left and right resulting level and/or gain estimation units (RLG1, RLG2) are e.g. configured to provide the resulting left and right level estimates (RLE1, RLE2) and/or resulting left and right gains (RG1, RG2), respectively, in dependence of the left and right binaural level modification estimates (BLME1, BLME2) and the left and right slow level estimates (SLE1, SLE2), respectively.

In the embodiments of FIGS. 3A, 3B and 3C, the left and right hearing devices (HD1, HD2) each comprises respective combination units (here forming part of signal processors (SP1, SP2)) configured to apply the respective resulting gain estimates (RG1, RG2) to the electric input signals (IN1, IN2) and/or to apply the resulting level estimates (RLE1, RLE2) of the electric input signals (IN1, IN2) in processing algorithms of the signal processors (SP1, SP2) of the left and right hearing devices (HD1, HD2).

In an embodiment, the resulting level estimates (RLE1, RLE2) are provided to the respective signal processors (SP1, SP2) of the left and right hearing devices and used in the processing of the forward path, e.g. to apply compressive amplification to the respective electric input signals (IN1, IN2). In another embodiment, the left and right resulting level and/or gain estimation units (RLG1, RLE2) comprises respective level-to-gain units (compressors) for implementing a compressive amplification algorithm and providing resulting gains (RG1, RG2), for application to the respective input signals in the forward path (here in the respective signal processors (SP1, SP2)).

In the embodiments of FIGS. 3A, 3B and 3C, the input units (IU1, IU2) of the left and right hearing devices (HD1, HD2) may each comprise a number of input transducers (IT, e.g. one or more microphones) and a (e.g. corresponding) number of analysis filter banks (t/f) to provide the respective electric input signals (IN1, IN2) as frequency sub-band signals in a number K of frequency bands. In an embodiment, where two or more input transducers, e.g. microphones, are provided, the input units (IU1, IU2) may further comprise a beamformer (e.g. a GSC, such as an MVDR beamformer) for providing a beamformed signal as a weighted combination of the two or more input signals. In such case, the respective electric input signals (IN1, IN2) may be the respective beamformed signals. The output units (OU1, OU2) of the left and right hearing devices (HD1, HD2) each comprise a synthesis filter bank (f/t) to provide the respective K processed frequency sub-band signals (OUT1, OUT2) as time-domain signals, and an output transducer (OT, e.g. comprising one or more loudspeakers or vibrators, or electrode arrays) for generating stimuli perceivable by a user as sound based on the respective processed time-domain signals.

The embodiment of FIGS. 3B and 3C are similar in function to the embodiment of FIG. 3A, but represent different partitions for the binaural hearing system. The embodiment of FIG. 3A may e.g. represent a partition comprising left and right hearing devices (HD1, HD2) and an auxiliary device (AD) comprising all or a major part of the binaural level and/or gain estimator. The embodiment of FIG. 3B represents a partition comprising left and right hearing devices (HD1, HD2) and an auxiliary device (AD) comprising the binaural level control unit (BLCNT). This has the advantage that the parameters dependent on inputs (FLE1, FLE2) from both sides (left and right) are determined in one separate auxiliary device that provides the respective binaural level and/or gain modification estimates (BL/GME1, BL/GME2) of the left and right hearing devices. The embodiment of FIG. 3C represents a partition comprising left and right hearing devices (HD1, HD2), where an auxiliary device (AD) can be dispensed with. This comes at the cost of having to have separate binaural level control units (BLCNT1, BLCNT2) in the left and right hearing devices.

In the embodiments of FIGS. 3A, 3B, 3C, the binaural level and/or gain estimator BLGD is assumed to provide level estimates of the respective electric input signals (or other signals of the forward path) in K frequency sub-bands. Alternatively, the binaural level and/or gain estimator BLGD may be configured to provide level estimates in a smaller number of frequency sub-bands (cf. e.g. FIG. 4A, 4B, where level estimates are provided in Kx<K frequency sub-bands (hence the need for frequency band reduction units (K→Kx) and band distribution units (Kx→K), respectively). In the embodiment of FIG. 3C, it is assumed that the level estimates (FLE1, FLE2) (cf. FIG. 3C) are exchanged between the left and right hearing devices (HD1, HD2) in K frequency sub-bands. In the embodiment of FIG. 3B, it is assumed that the level estimates (FLE1, FLE2) and additionally binaural modification signals (BL/GME1, BL/GME2) are exchanged between the left and right hearing devices (HD1, HD2) and the binaural control unit (BLCNT) in K frequency sub-bands. In an embodiment, the exchange of signals (or of some of the signals) may be performed in fewer frequency bands, to reduce bandwidth requirements of the wireless link (and/or to save power in the hearing system.

FIGS. 4A and 4B show a binaural hearing system comprising a binaural level and/or gain estimator according to embodiments of the present disclosure.

The embodiments of a binaural hearing system of FIGS. 4A and 4B are similar in partition to the embodiment of FIG. 3B, comprising left and right hearing devices (HD1, HD2) and an auxiliary device (AD) comprising the binaural level control unit (BLCNT). Other partitions may be implemented depending on the requirements of the application in question (see e.g. FIG. 10A, 10B, 10C).

In the embodiments of FIGS. 4A and 4B, the left and right level estimators (LD1, LD2) are configured to determine the fast and slow level estimates in a number of frequency sub-bands Kx, where Kx is smaller than or equal to K (Kx≤K). In the embodiments of FIGS. 4A and 4B, the resulting level estimates and/or the resulting gains are determined on a frequency sub-band level (here in Kx sub-bands). In the embodiments of FIGS. 4A and 4B, the left and right hearing devices (HD1, HD2) comprise respective band reduction units (K→Kx) and band distribution units (Kx→K) to adapt a possible difference between the number of frequency bands K in the forward path and the number of frequency bands Kx in the level/gain estimation path. In an embodiment, Kx<K. In an embodiment, Kx=K. In an embodiment, Kx>K.

In the embodiments of FIGS. 4A and 4B, the level estimators (LD1, LD2) are adapted to provide that attack and/or release time constant(s) ($\tau_{att}$, $\tau_{rel}$) used to determine the slow level estimate (SLE1, SLE2) are configurable in dependence of the electric input signals (IN1, IN2). The level estimators (LD1, LD2) may e.g. comprise the functional elements as shown in and discussed in connection with FIGS. 7A, 7B (and described in WO2003081947A1).

The embodiment of FIG. 4A is functionally identical to the embodiment of FIG. 3B. The binaural control unit (BLCNT) of the embodiment of FIG. 4A comprises a fast binaural level comparison unit (FBLCU) for comparing respective left and right fast level estimates (FLE1, FLE2) and providing a fast comparison measure ΔFLE, e.g. an algebraic difference. The binaural control unit (BLCNT) further comprises a 'binaural influence function', here a fast binaural level influence function (FBL-IF) for determining a binaural modification of the levels at the respective ears of the user as a function of the fast comparison measure ΔFLE, e.g. the actual (estimated) fast level differences ΔFLE(i,j) =FLEi-FLEj, i, j=1,2, while i≠j (see e.g. FIG. 6 below). The fast binaural level influence function (FBL-IF) provides respective binaural (fast) level and/or gain modification estimate signals (BL/GME1, BL/GME2), which are fed to the respective left and right resulting level and/or gain estimation units (RLG1, RLG2). The binaural control unit (BLCNT) may e.g. be embodied in an auxiliary device (AD) (cf. also FIGS. 3B and 10B) connected to the left and right hearing devices (HD1, HD2), e.g. via wireless links WL between the hearing devices and the auxiliary device. Thereby the relevant signals (FLE1, FLE2, and BL/GME1, BL/GME2) can be exchanged.

FIG. 4B shows a binaural hearing system comprising a binaural level and/or gain estimator according to a third embodiment of the present disclosure.

In the embodiment of FIG. 4B, the fast and the slow outputs (FLE1/FLE2, SLE1/SLE2) are compared across the two ears to get both relatively fast and relatively slow estimates of the ILD cues. These two differences are then used in two 'binaural influence functions', which are (e.g. piecewise linear) influence functions that determine a binaural modification of the levels at the respective ears of the user as a function of actual (estimated) level differences (see e.g. FIG. 6B below). The output from these (fast and slow) influence functions (BLME1, BLME21, and BLME12, BLME22, respectively) guide the slow level estimators (SLD1, SLD2) on the two sides in combination with the local (monaural) fast and slow level estimates (FLE1, SLE1, and FLE2, SLE2, respectively), in order to modify the fast ILD cues and/or the slow ILD cues. The functionality can be used to attenuate, restore or enhance the binaural cues as desired according to the audiological idea.

In the embodiment of FIG. 4B, the left and right hearing devices (HD1, HD2) are configured to transmit the respective (monaural) fast level estimates (FLE1, FLE2) of the electric input signals (IN1, IN2) to the binaural level control unit (BLCNT), and to receive respective binaural (fast) level modifications (BLME11, BLME21) from the binaural level control unit (BLCNT). The level estimators (LD1, LD2) of the left and right hearing devices (HD1, HD2) are configured to use the binaural (fast) level modifications (BLM11, BLME21) to modify the time constants ($\tau_{sid1}\tau_{sid2}$) of the respective slow level estimators (SLD1, SLD2), cf. respective time constant controllers (SL-CNT1, SL-CNT2) providing respective control signals (SLC1, SLC2) to the slow level estimators (SLE1, SLE2). The left and right hearing devices (HD1, HD2) are further configured to transmit the respective (monaural) slow level estimates (SLE1, SLE2) of the electric input signals (IN1, IN2) to the binaural level control unit (BLCNT), and to receive respective binaural (slow) level modifications (BLME12, BLME22) from the binaural level control unit (BLCNT). The binaural control unit (BLCNT) of the embodiment of FIG. 4B comprises a slow binaural level comparison unit (SBLCU) for comparing respective left and right slow level estimates (SLE1, SLE2) and providing a slow comparison measure ΔSLE, e.g. an algebraic difference. The binaural control unit (BLEND further comprises a 'binaural influence function', here a slow binaural level influence function (SBL-IF) for determining a binaural modification of the levels at the respective ears of the user as a function of the slow comparison measure ΔSLE, e.g. the actual (estimated) slow level differences (or logarithmic versions thereof) ΔSLE(i,j)=SLEi-SLEj, i, j=1,2, while (see e.g. FIG. 6B below). The slow binaural level influence function (SBL-IF) provides the respective binaural (slow) level modification signals (BLM12, BLME22), which are fed to the respective left and right resulting level and/or gain estimation units (RLG1, RLG2). As the embodiment of FIG. 4A, the binaural control unit (BLCNT) of the embodiment of FIG. 4B may e.g. be embodied in an auxiliary device (AD) connected to the left and right hearing devices (HD1, HD2), e.g. via wireless links WL between the hearing devices and the auxiliary device. Thereby the relevant signals (FLE1, FLE2, SLE1, SLE2 and BLME11, BLME21, BLME12, BLME22) can be exchanged.

In the embodiments of FIGS. 4A, and 4B, the left and right hearing devices (HD1, HD2) and the auxiliary device (AD) comprising the binaural control unit (BLCNT) may thus comprise appropriate antenna and transceiver circuitry (Rx/Tx1, Rx/Tx2, in HD1 and HD2, respectively, etc.) configured to establish the wireless links (WL) between the left and right hearing devices and the auxiliary device to provide that information signals, including the level estimates, etc., can be exchanged between the left and right hearing devices (HD1, HD2) and the auxiliary device (AD). Alternatively, the hearing devices and the auxiliary device may be interconnected by electric cables or other communication technologies.

Figure 5:
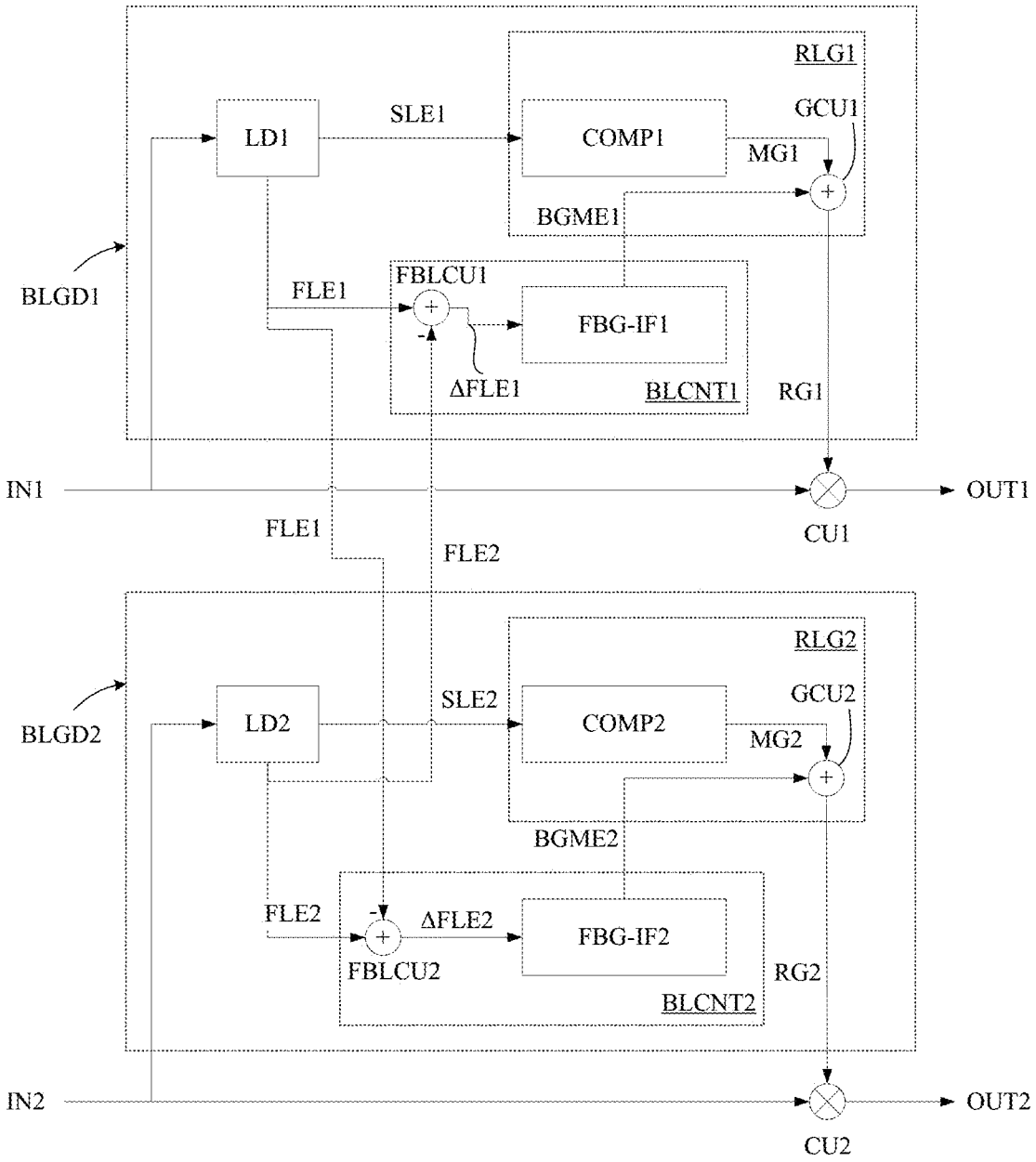
FIG. 5 shows a part of a binaural hearing system comprising a binaural level and/or gain estimator according to a sixth embodiment of the present disclosure.

FIG. 5 shows a part of a binaural hearing system comprising a binaural level and/or gain estimator (BLGD1, BLGD2) according to an embodiment of the present disclosure. The binaural level and/or gain estimator in FIG. 5 is shown as two parts (BLGD1, BLGD2), each being configured to receive a left and right electric input signal (IN1, IN2), respectively, representative of sound picked up (e.g. by respective microphones) at left and right ears of a user. In practice the two parts may form part of respective left and right hearing devices, as e.g. illustrated in FIGS. 3C and 10C. Alternatively, the two parts may be partitioned in other ways, see e.g. FIG. 10A, 10B. The binaural level and/or gain estimator (BLGD1, BLGD2) comprises left and right level estimators (LD1, LD2) each providing respective left and right fast and slow level estimates (FLE1, SLE1, and FLE2, SLE2) of the respective left and right electric input signals (IN1, IN2), as described in connection with FIGS. 3A, 3B, 3C or FIG. 4A, 4B. The binaural level and/or gain estimator (BLGD1, BLGD2) further comprises a fast binaural level comparison unit (FBLCU1, FBLCU2), here implemented as respective sum-units '+', for receiving the respective fast level estimates (FLE1, FLE2) of the left and right level estimators (LD1, LD2) and for providing respective left and right fast binaural level comparison estimates (ΔFLE1, ΔFLE1) in dependence thereof, here as algebraic differences between the two input signals. The binaural level and/or gain estimator (BLGD1, BLGD2) further comprises respective fast binaural gain enhancers (FBG–IF1, FBG–IF2) providing respective left, and right binaural gain modification estimates (BGME1, BGME2), in dependence of the respective fast binaural level comparison estimates (ΔFLE1, ΔFLE1) at the left and right ears, respectively, of the user. The left fast binaural gain modification estimate (BGME1) is determined by amplifying the difference between the fast level estimates of the left and right fast level estimators (BGME1=A1(FLE1–FLE2), where A1 is positive multiplication factor larger than 1), and the right fast binaural gain modification estimate (BGME2) is determined by amplifying the difference between the fast level estimates of the right and left level estimators (BGME2=A2·(FLE2–FLE1), where A2 is a positive multiplication factor larger than 1, equal to or different from A1. The respective left and right binaural level and/or gain estimators (BLGD1, BLGD2) further comprises respective left and right resulting level and/or gain estimation units (RLG1 RLG2) configured to provide the resulting left and right gain estimates, respectively, in dependence of the left and right binaural gain modification estimates (BGME1, BGME2), respectively, and the slow level estimates (SLE1, SLE2) of the left and right electric input signals (IN1, IN2), respectively. The left and right resulting level and/or gain estimation units (RLG1, RLG2) each comprises respective compressor units (COMP1, COMP2, level to gain conversion units), e.g. for implementing a compressive amplification algorithm adapted to a user's needs. The respective compressor units (COMP1, COMP2) provides respective main gains (MG1, MG2) in dependence of respective slow level estimates (SLE1, SLE2) of the input signals (IN1, IN2). The left and right resulting level and/or gain estimation units (RLG1, RLG2) each further comprises respective gain combination units (GCU1, GCU2, here sum units '+') for combining (here adding) the respective left and right main gains (MG1, MG2) and the left and right binaural gain modification estimates (BGME1, BGME2), respectively, to provide the resulting gains (RG1, RG2), respectively. The forward paths of the respective left and right hearing devices (HD1, HD2), each comprises a combination unit (here a multiplication unit '×') for applying the respective resulting (binaurally modified compressor gains) to the left and right electric input signals (IN1, 1N2) or further processes versions thereof to provide respective output signals OTT1, OUT2 (which need not be output signals of the hearing devices, but may be further processed in the forward path before being presented to the user).

The binaural level and/or gain estimator (BLGD, e.g. partitioned as BLGD1 and BLGD2), including the left and right level estimators (LD1, LD2) and the binaural level control unit (BLCNT), may e.g. be embodied as discussed above and illustrated in FIG. 4A, 4B, or FIG. 5.

The binaural level and/or gain estimator (BLGD) may e.g. be embodied in a separate processing unit, e.g. a remote control of a hearing system according to the present disclosure or be distributed between left and right hearing devices (HD1, HD2) and optionally between left and right hearing devices (HD1, HD2) and an auxiliary device (AD), as e.g. illustrated in FIG. 3A, 3B, 3C, 4A, 4B, 5, 10A, 10B, 10C.

In an embodiment, the left and right resulting level and/or gain estimation units (RLG1, RLG2) each comprises respective level-to-gain units (compressors) for implementing a compressive amplification algorithm and providing the resulting gains (RG1, RG2) for application to the respective left and right electric input signals (IN1, IN2). This has the advantage of providing an appropriate dynamic level adaptation of the levels of the left and right electric input signals, including spatial cues in the form of enhanced interaural level differences, according to a user's needs.

Figure 6A:
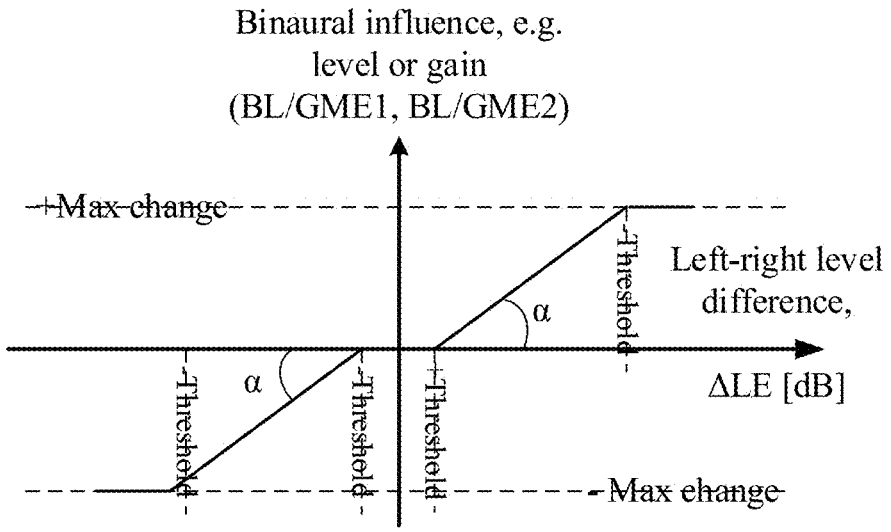
FIG. 6A shows a generic exemplary binaural influence function for a binaural level ani/or gain estimator according to an embodiment of the present disclosure.

FIG. 6A shows a generic exemplary binaural influence function for a binaural level and/or gain estimator according to an embodiment of the present disclosure. FIG. 6A illustrates an exemplary influence function used in a fast binaural level and/or gain enhancer (FBL/G-IF) to determine respective left and right binaural level and/or gain modification estimates (BL/GME1, BL/GME2) in dependence of a level comparison estimate (ΔLE) (e.g. the fast binaural level comparison estimate (ΔFLE)) at said left and right ears, respectively, of the user. The horizontal axis (ΔLE) is denoted Left-right level difference, ΔLE and is assumed to be in a logarithmic scale, e.g. in dB. FIG. 6A shows a piecewise linear dependence of the binaural influence function of the level comparison estimate (ΔLE), exhibiting a constant or increasing value of the binaural influence function for increasing values of the level comparison estimate (ΔLE). Alternatively, it may be a smooth (e.g. monotonous) curve, e.g. an S-shaped, such as a sigmoid, curve. The binaural influence function comprises minimum and maximum limitation values (both indicated as Max change and the corresponding ΔLE-values as Threshold in FIG. 6A), e.g. reflecting a desire to keep signals audible and not uncomfortable, respectively, to the user. The exemplary binaural influence function of FIG. 6A is zero in a range around the zero point for level comparison estimate (ΔLE=0), between a negative and a positive 'zero-threshold' value of ΔLE (both threshold values denoted. Threshold in FIG. 6A). The values of the binaural influence function corresponding to positive and negative ΔLE values correspond to the side closest to and farthest away from, respectively, a currently active sound source. A slope α of the binaural influence-curve larger than 1 corresponds to an amplification of the measured (or rather estimated) binaural level difference ΔLE (e.g. corresponding to the interaural level difference, ILD), whereas a slope α of the binaural influence-curve smaller than 1 corresponds to a compression of the binaural level difference ΔLE. The exemplary binaural influence function of FIG. 6A is shown to be symmetric around the centre of the coordinate system (0,0) (180° rotational symmetry). This need not be the case, however. The different thresholds, may have different values, e.g. to enhance (or suppress) positive values more than negative values of the binaural level difference.

Figure 6B:
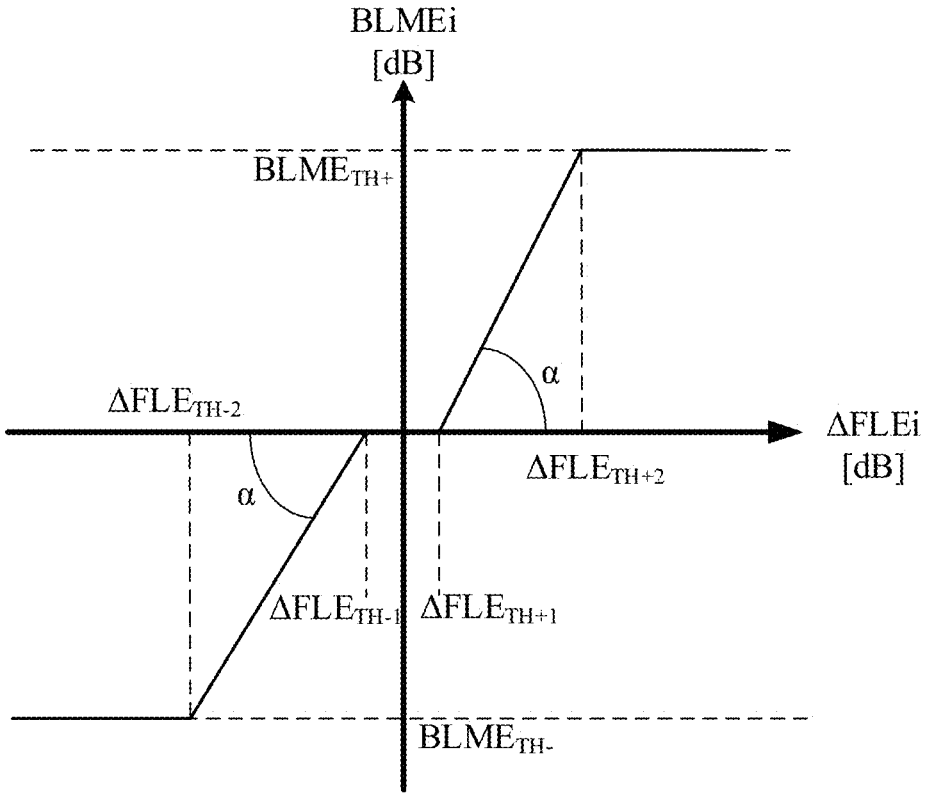
FIG. 6B shows an exemplary binaural fast level influence function for a binaural level control unit according to the present disclosure.

FIG. 6B shows an exemplary binaural fast level influence function for a binaural level control unit according to the present disclosure. The graph shows a binaural level modification estimate (BLMEi [dB]) as a function of a fast binaural level comparison estimates (ΔFLEi [dB]).

The exemplary binaural fast level influence function BLMEi of FIG. 6 exhibits a slope α larger than 1 between the first and second threshold values (knee points) on the positive and negative axis respectively. In the positive range, where the slope $\alpha>1$, and $\Delta FLE_{TH+2}>\Delta FLEi>\Delta FLE_{TH+1}$, the fast binaural level comparison estimate ΔFLEi is amplified, so that BLMEi>ΔFLEi. For values of ΔFLEi above the second positive threshold value $\Delta FLE_{TH+2}$, the binaural fast level influence function BLMEi is constant equal to a maximum threshold value $BLME_{TH+}$. Correspondingly, in the negative range, where the slope $\alpha>1$, and $\Delta FLE_{TH-1}>\Delta FLEi>\Delta FLE_{TH-2}$, the fast binaural level comparison estimate ΔFLEi is amplified, so that BLMEi<ΔFLEi (cf. e.g. FIG. 2A, 2B). For values of ΔFLEi below the second negative threshold value $\Delta FLE_{TH-2}$, the binaural fast level influence function BLMEi is constant equal to a minimum threshold value $BLME_{TH}$. In the example illustrated in FIG. 6B, a given value of ΔFLE1 would result in a value of BLME1. Due to the symmetry of the graph, ΔFLE2=−ΔFLE1, and BLME2=−BLME1. As indicated above such symmetry may or may not be present.

Exemplary threshold values of $\Delta FLE_{TH+1}$, $\Delta FLE_{TH+1}$ may e.g. be +/−1 dB, of $\Delta FLE_{TH+1}$, $\Delta FLE_{TH+1}$ may be +/−10 dB, and of $BLME_{TH+}$, $BLME_{TH-}$ may be a +/−20 dB. An exemplary value of the slope α could thus be 1.9.

Figure 7A:
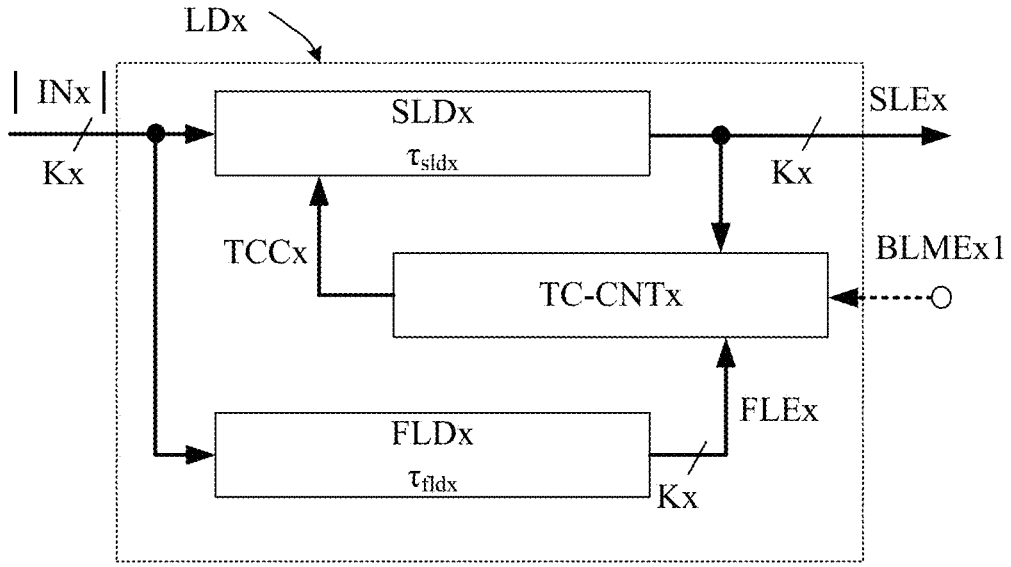
FIG. 7A shows an exemplary structure of a level estimator for use in a binaural level and/or gain estimator according to the present disclosure.
Figure 7B:
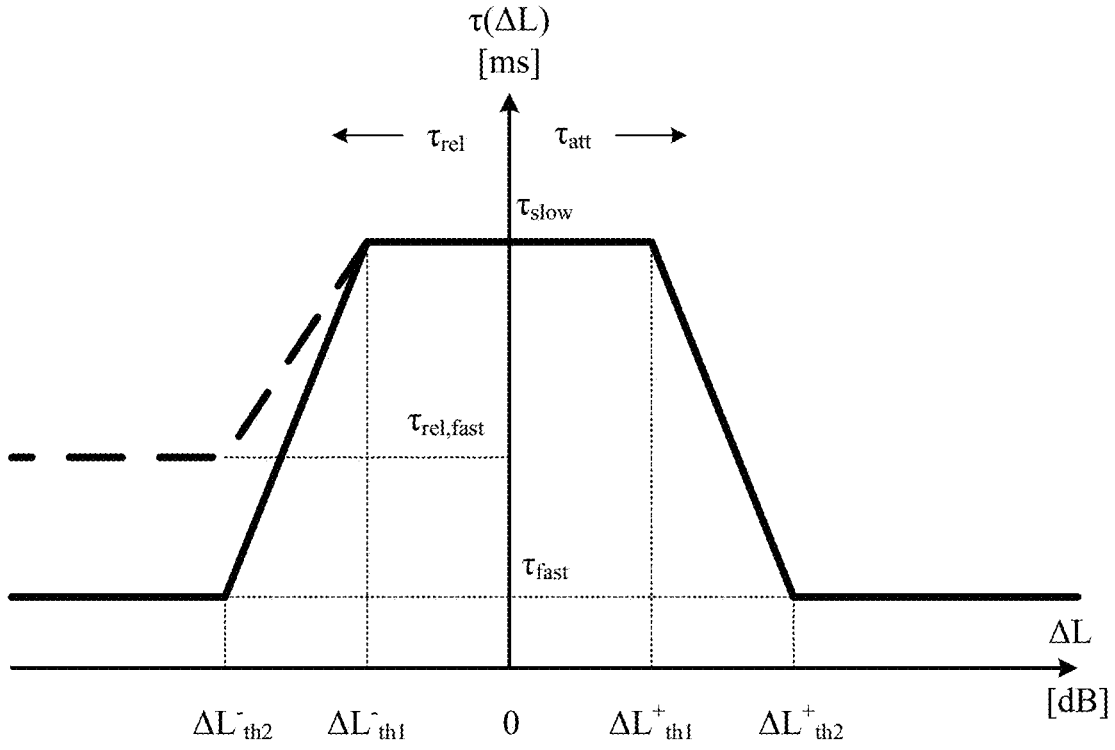
FIG. 7B schematically shows an exemplary scheme (influence function) for determining attack and release times for the level estimator of FIG. 7A in dependence of the input signal.

FIG. 7A shows an exemplary structure of a level estimator for use in a binaural level and/or gain estimator according to the present disclosure; and FIG. 7B schematically shows an exemplary scheme (influence function) for determining attack and release times for the level estimator of FIG. 7A in dependence of the input signal.

The configurable level estimator (LDx) of FIG. 7A uses a slow level estimator (SLDx) for slowly varying levels, in parallel with a fast level estimator (FLDx) to detect fast changes in the signal, 'Slow' and 'fast' in the 'slow estimator' and in the 'fast level estimator' refers to time constants $\tau_{slow}$, and $\tau_{fast}$, respectively, used in level estimation (where $\tau_{slow}>\tau_{fast}$). The 'slow estimator' (SLDx) is implemented as a configurable (or guided) level estimator. The outputs (SLEx, FLEx) from the two detectors are compared (in control unit TC-CNTx), and if the level difference is larger than a, e.g. predetermined, threshold value, the fast detector (FLDx) is used to move the slow detector (SLDx) in place quickly (by decreasing time constants), hence the term 'guided'. The time constant controller (TC-CNTx) provides control signal TCCx for controlling or providing time constants ($\tau_{att}$, $\tau_{rel}$) of the slow level estimator (SLDx). A level estimator (LDx) as shown in FIG. 7A is e.g. described in WO2003081947A1. (for one frequency band). In the embodiments of a binaural level and/or gain estimator shown in FIG. 7A, and in the first and second level estimators (LD1 and LD2) shown in FIG. 4A, 4B, level estimation is provided in a number Kx of frequency bands (i.e. each dynamic level estimator providing Kx level estimates as an output). The level estimator (LDx) may be configurable to provide level estimates in an appropriate number of frequency bands.

The level estimator (LDx) is adapted to provide an estimate SLEx of a level of (the magnitude |INx| of) an input signal INx to the level estimator. Attack and/or release time constant(s) ($\tau_{att}$, $\tau_{rel}$) of the slow level detector is/are dynamically configurable in dependence of the input signal INx (|INx|). The fast and slow level estimators both receive the input signal Inx (|INx|). The slow level estimator (SLDx) is configured to provide the estimate of the level SLEx of the input signal.

A further (optional) input BLMEx1 to the time constant control unit TC-CNTx is shown in FIG. 7A intended to provide a binaural influence on the slow level estimate. This is discussed in connection with FIG. 49. In an embodiment, the current binaural level modification (BLMEx1) is added to the current difference (ΔL in FIG. 7B) between the fast (FLEx) and slow level estimates (SLEx) in the respective left and right hearing devices. This may e.g. result in a corresponding level-bias in the influence function compared to the one illustrated in FIG. 7B.

FIG. 7B schematically shows an exemplary scheme for determining attack and release time constants ($\tau_{att}$, $\tau_{rel}$) for the level estimator (LDx) of FIG. 7A in dependence of the input signal INx (|INx|), also termed the time constant influence function, here embodied in a time constant versus level difference function τ(ΔL). The bold, solid graph in FIG. 7B illustrates an exemplary dependence of attack and release time constants ($\tau_{att}$, $\tau_{rel}$) [unit e.g. ms] of the slow level estimator (SLDx) in dependence of a difference ΔL (unit [dB]) between a level estimate FLEx of the fast level estimator (FLDx) and a level estimate SLEx of the slow level estimator (SLDx), ΔL=FLEx−SLEx. FIG. 7B implements a strategy, where relatively large attack and release time constants ($\tau_{slow}$) are applied to the slow level estimator (SLDx) in case of (numerically) relatively small (positive or negative) level differences ΔL. For level differences larger than $\Delta L^{+}_{th1}$ (or smaller than $\Delta L^{-}_{th1}$), the attack time (or release time) decreases with increasing (or decreasing) value of ΔL, until a threshold value $\Delta L^{+}_{th2}$ ($\Delta L^{-}_{th2}$) of the level difference. For level differences larger than $\Delta L^{+}_{th2}$ (or smaller than $\Delta L^{-}_{th2}$), the attack (or release) time constant is held at a constant minimum value ($\tau_{fast}$). In the graph of FIG. 7B, the course of the bold solid τ(ΔL) curve is symmetrical around 0. This need not be the case however. Likewise, the bold solid τ(ΔL) curve also indicates that the attack and release times are of equal size for the same numerical value of the level difference. This needs not be the case either. In an embodiment, the release times are generally larger than the attack times, or at least the release time constants for large negative values of level difference ΔL ($\Delta L<\Delta L^{-}_{th1}$), may be larger than the attack time constant for corresponding large positive values of level difference ΔL ($\Delta L>\Delta L^{+}_{th1}$). This is indicated by the dashed curve illustrating an alternative course of the release time $\tau_{rel}(\Delta L)$ exhibiting a lager 'fast release time' ($\tau_{rel,fast}$) than for the bold solid curve). Likewise, the release times may be generally larger than the attack times for relatively small level differences (e.g. for $0\leq\Delta L\leq\Delta L^{+}_{th1}$ and $0\leq\Delta L\leq\Delta L^{+}_{th1}$, respectively). The graph assumes a trapezoid form comprising linear segments between knee points. Other (e.g. curved) functional forms may be implemented. The time constant versus level difference function τ(ΔL) may be identical for all frequency bands of a given dynamic level estimator. Alternatively, the function may be different for some or all bands (or channels). In an embodiment, the time constant versus level difference function τ(ΔL) is equal for the first and second level estimators (LD1, LD2) of FIG. 4A, 4B. The time constant versus level difference function τ(ΔL) may, however, be different for the first and second level estimators (LD1, LD2) of FIG. 4A, 4B (e.g. adapted to a specific user's needs).

Figure 8A:
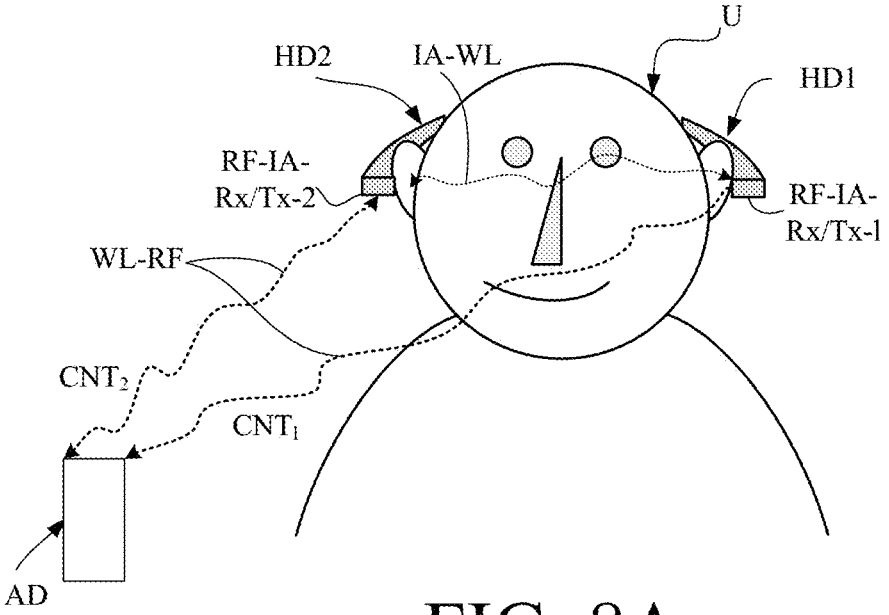
FIG. 8A shows an exemplary application scenario of an embodiment of a binaural hearing system according to the present disclosure, the scenario comprising a user, a binaural hearing aid system and an auxiliary device.
Figure 8B:
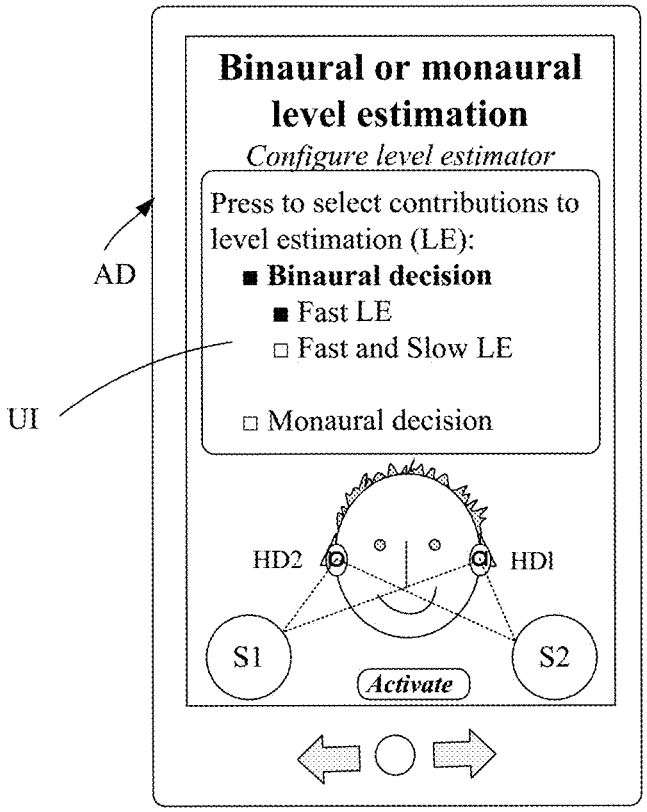
FIG. 8B illustrates the auxiliary device running an APP allowing a user to influence the function of the binaural level and/or gain estimator of the binaural hearing system.

FIGS. 8A and 8B illustrate an exemplary application scenario of an embodiment of a hearing system according to the present disclosure. FIG. 8A illustrates a user (U), a binaural hearing aid system and an auxiliary device (AD). FIG. 8B illustrates the auxiliary device (AD) running an APP for controlling the binaural hearing system (specifically level estimation). The APP is a non-transitory application (APP) comprising executable instructions configured to be executed on a processor of the auxiliary device (AD) to implement a user interface (UI) for the hearing system (including hearing devices (HD1, HD2)). In the illustrated embodiment, the APP is configured to run on a smartphone, or on another portable device allowing communication with the hearing system. In an embodiment, the binaural hearing aid system comprises the auxiliary device AD (and the user interface UI). In the embodiment, the auxiliary device AD comprising the user interface UI is adapted for being held in a hand of a user (U).

In FIG. 8A, wireless links denoted IA-WL (e.g. an inductive link between the left and right devices) and WL-RF (e.g. RF-links (e.g. based on Bluetooth or some other standardized or proprietary scheme) between the auxiliary device AD and the left HD1, and between the auxiliary device AD and the right HD2, respectively) are implemented in the devices (HD1, HD2) by corresponding antenna and transceiver circuitry (indicated in FIG. 8A in the left and right hearing devices as RF−IA−Rx/Tx−1 and RF−IA−Rx/Tx−2, respectively). The wireless links are configured to allow an exchange of audio signals and/or information or control signals (including level estimates and data related to level estimates, e.g. gains) between the hearing devices (HD1, HD2) and between the hearing devices (HD1, HD2) and the auxiliary device (AD) (cf. signals $CNT_1$, $CNT_2$).

FIG. 8B illustrates the auxiliary device running an APP allowing a user to influence the function of the binaural level and/or gain estimator of the binaural hearing system. A screen of the exemplary user interface (UI) of the auxiliary device (AD) is shown in FIG. 8B. The user interface comprises a display (e.g. a touch sensitive display) displaying a user of the hearing system comprising first and second hearing devices, e.g. hearing aids, (HD1, HD2) in a multi sound source environment comprising two or more sound sources (S1, S2). In the framed box in the center of the screen a number of possible choices defining the configuration of the level estimation of the system. Via the display of the user interface (under the heading Binaural or monaural level estimation. Configure level estimator), the user (U) is instructed to Press to select contributions to level estimation (LE):

Binaural decision

Fast LE

Fast and Slow LE

Monaural decision

The user should press Activate to initiate the selected configuration.

These instructions should prompt the user to select level estimation based on a Binaural decision or a Monaural decision (i.e. whether the resulting level estimates of an input signal at a given ear is influenced by a level estimate at the other ear (=binaural decision according to the present disclosure) or whether level estimates at the two ears are independent (monaural, only dependent on the local level estimate). The filled square and bold face writing indicates that the user has selected level estimation to be based on a Binaural decision, where the level estimates are exchanged between the two hearing devices and used to qualify the resulting estimate of the local level estimator (as also proposed in the present disclosure). In Binaural decision mode, it is further an option to choose whether the binaural modification should be based on fast level detection alone (Fast LE, cf. e.g. 3A, 3B, 3C and FIG. 4A) or on fast as well as slow level detection (Fast and Slow LE, cf. e.g. FIG. 4B). When the level estimator has been configured, activation of the selected combination can be initiated by pressing Activate.

The user interface (UI) may e.g. be configured to select 'Binaural decision' and 'Fast LE' as default choices.

In an embodiment, the APP and system are configured to allow other possible choices regarding level estimation, e.g. regarding the number of frequency bands used in the fast and slow level estimators.

Other screens of the APP (or other APPs or functionality are accessible via activation elements (arrows and circle) in the bottom part of the auxiliary device.

Figure 9:
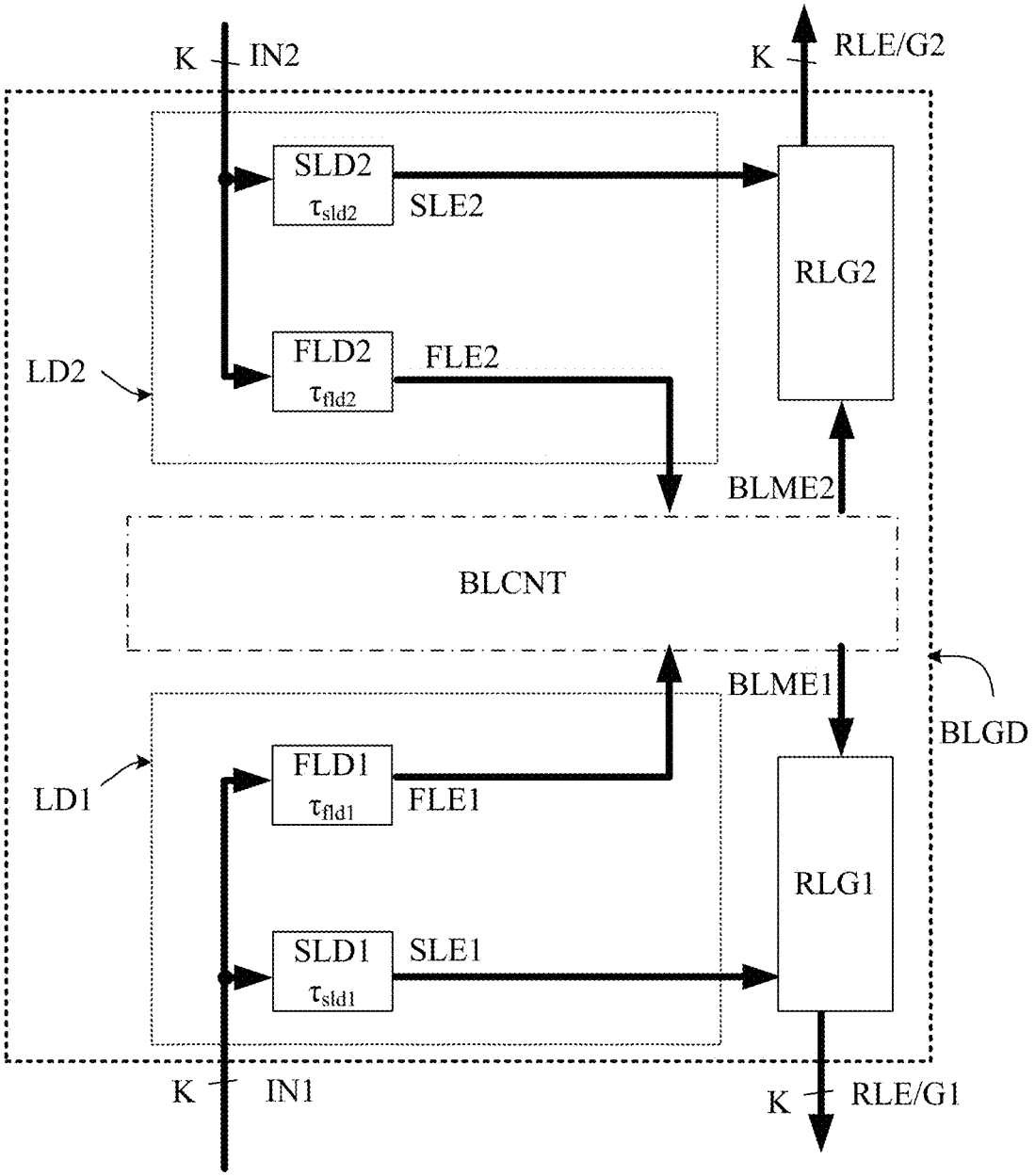
FIG. 9 shows an embodiment of a binaural level and/or gain estimator according to the present disclosure.

FIG. 9 shows an embodiment of a binaural level and/or gain estimator according to the present disclosure, configured to receive left and right electric input signals (IN1, IN2) representative of sound picked up (e.g. by respective microphones) at left and right ears of a user. In the embodiment of FIG. 9, the left and right electric input signals (IN1, IN2) are provided in K frequency sub-bands. The binaural level and/or gain estimator (BLGD) comprises left and right level estimators (LD1, LD2). The Left and right level estimators each comprises A) a fast level estimator (FLD1, FLD2) configured to provide respective left and right fast level estimates (FLE1, FLE2) of the respective left and right electric input signals (IN1, IN2), and B) a slow level estimator (SLD1, SLD2) configured to provide a slow level estimate (SLE1, SLE2) of the respective electric input signal. The attack and/or release times ($\tau_{fld1}$, $\tau_{fld2}$) of the slow level estimators (SLD1, SLD2) are larger than attack and/or release times ($\tau_{fld1}$, $T_{fld2}$) of the fast level estimators (FLD1, FLD2). The binaural level and/or gain estimator (BLGD) further comprises a binaural level control unit (BLCNT) for receiving the fast level estimates (FLE1, FLE2) of the respective left and right fast level estimators (FLD1, FLD2) and for providing respective left and right binaural level modification estimates (BLME1, BLME2) in dependence thereof. The left binaural level modification estimate (BLME1) is determined by amplifying the difference between the fast level estimates of the left and right fast level estimators (BLME1=A1 (FLE1−FLE2), where A1 is positive multiplication factor larger than 1), and the right binaural level modification estimate (BLME2) is determined by amplifying the difference between the fast level estimates of the right and left level estimators (BLME2=A2·(FLE2−FLE1), where A2 is positive multiplication factor larger than 1). The binaural level and/or gain estimator (BLGD) further comprises respective left and right resulting level and/or gain estimation units (RLG1, RLG2) configured to provide the resulting left and right level estimates ((RLE1, RLE2) and/or the resulting left and right gains (RG1, RG2), respectively, in dependence of the left and right binaural level modification estimates (BLME1, BLME2), respectively, and the slow level estimates (SLE1, SLE2) of the left and right electric input signals (IN1, IN2), respectively.

The binaural level and/or gain estimator (BLGD), including the left and right level estimators (LD1, LD2) and the binaural level control unit (BLCNT), may e.g. be embodied as discussed above and illustrated in FIG. 4A, 4B, or FIG. 5.

The binaural level and/or gain estimator (BLGD) may e.g. be embodied in a separate processing unit, e.g. a remote control of a hearing system according to the present disclosure or be distributed between left and right hearing devices (HD1, HD2) and optionally between left and right hearing devices (HD1, HD2) and an auxiliary device (AD), as e.g. illustrated in FIG. 3A, 3B, 3C, 4A, 4B, 5, 10A, 10B, 10C.

In an embodiment, the left and right resulting level and/or gain estimation units (RLG1, RLG2) each comprises respective level-to-gain units (compressors) for implementing a compressive amplification algorithm and providing the resulting gains (RG1, RG2) for application to the respective left and right electric input signals (IN1, IN2). This has the advantage of providing an appropriate dynamic level adaptation of the levels of the left and right electric input signals, including spatial cues in the form of enhanced interaural level differences, according to a user's needs.

Figure 10A:
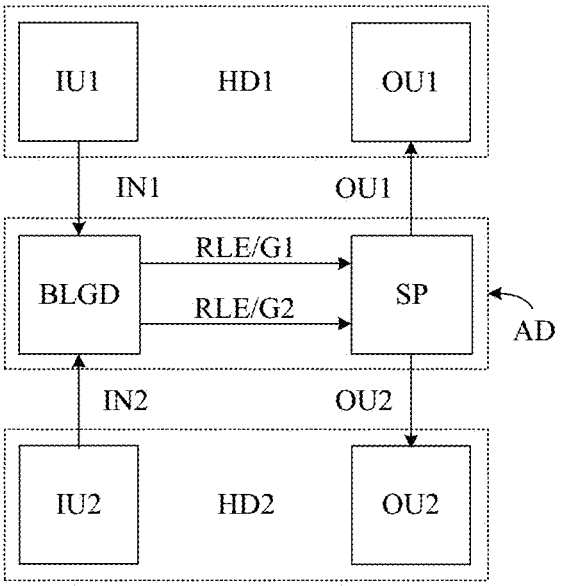
FIG. 10A illustrates a first partition of a binaural hearing system according to the present disclosure.
Figure 10B:
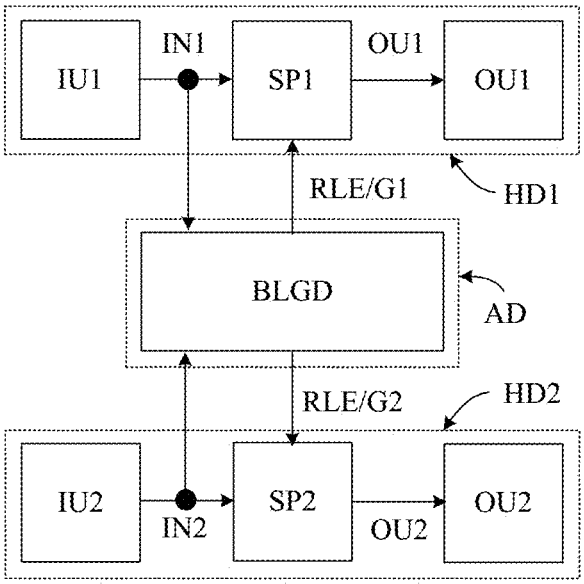
FIG. 10B illustrates a second partition of a binaural hearing system according to the present disclosure.
Figure 10C:
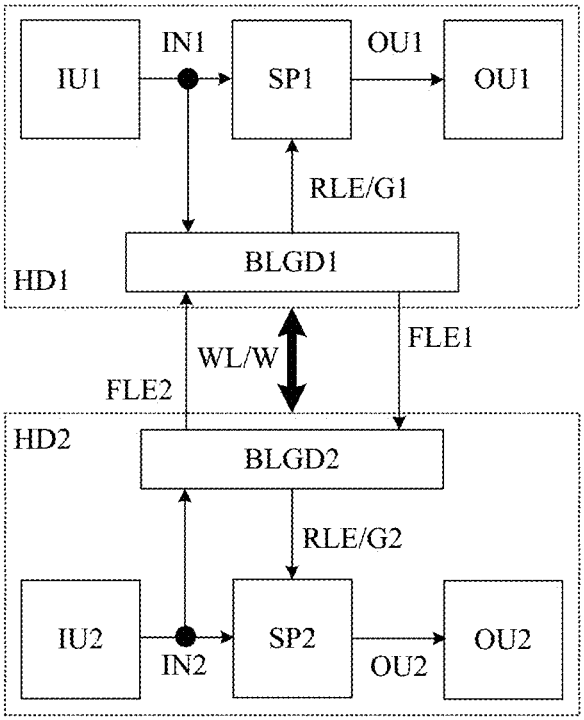
FIG. 10C illustrates a third partition of a binaural hearing system according to the present disclosure.

FIGS. 10A, 10B and 10C illustrate different exemplary partitions of a binaural hearing system comprising left and right hearing devices (HD1, HD2), and a binaural level and/or gain modification estimator (BLGD) according to the present disclosure.

The embodiment of FIGS. 10A and 10B both represent a partition comprising left and right hearing devices (HD1, HD2) and an auxiliary device (AD) comprising all or a major part of the binaural level and/or gain estimator (BLGD). This has the advantage that the parameters dependent on inputs from both sides (left and right) are determined in one separate auxiliary device (AD) that provides the respective binaural level and/or gain modification estimates (BL/GME1, BL/GME2) of the left and right hearing devices (FIG. 10B) or even applies the gain modification estimates to signals of the forward path (cf. FIG. 10A). Thereby power consuming tasks are off-loaded from the left and right hearing devices. In the embodiment of FIG. 10A, the signal processing is performed in the auxiliary device as well (cf. signal processor SP receiving resulting binaural level and/or gain estimates (RLE/G1, RLE/G2) from the binaural level and or gain estimator (BLGD)). In the embodiment of FIG. 10A, the left and right hearing devices (HD1, HD2) only comprise respective input and output units (IU1, IU2, and OU1, OU2). This simplifies the left and right hearing devices at the cost of requiring audio communication links between the left and right hearing devices and the auxiliary device that allow the exchange of input (IN1, IN2) and output (OU1, OU2) audio signals via the link. In the embodiment of FIG. 10B, only the binaural level and/or gain estimator (BLGD) is located in the auxiliary device (AD), whereas signal processing of the forward path of the haring devices is performed in respective signal processors (SP1, SP2) of the left and right hearing devices (HD1, HD2). This, on the other hand, simplifies the requirements to the wireless communication links between the left and right hearing devices and the auxiliary device, which only needs to exchange the input audio signals (IN1, IN2) and the resulting binaural level and/or gain estimates (RLE/G1, RLE/G2). The embodiment of FIG. 10B is similar in function and partition to the embodiment of FIG. 3A FIG. 10C illustrates a third partition of a binaural hearing system according to the present disclosure. The embodiment of FIG. 10C represents a partition comprising left and right hearing devices (HD1, HD2), where an auxiliary device (AD) can be dispensed with (as illustrated in more detail in FIG. 3C). This comes at the cost of having to have separate binaural level and/or gain modification units (BLGD1, BLGD2) in the left and right hearing devices. On the other hand, it relaxes the requirements to the link (WL/W) between the left and right hearing devices that only need to exchange appropriate level estimates (e.g. the respective fast level estimates (FLE1, FLE2)). As indicated, the link can be wireless or based on a wired connection.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

WO2003081947A1 (OTICON) Oct. 2, 2003
EP2445231A1 (OTICON) Apr. 25, 2012

The invention claimed is:

1. A binaural hearing system comprising left and right hearing devices adapted for being worn at or in left and right ears, respectively, of a user, or for being fully or partially implanted in the head at the left and right ears, respectively, of the user, the binaural hearing system comprising a binaural level and/or gain estimator being configured to receive fast level estimates from respective left and right fast level estimators with low attack/release time constants;

determine fast binaural level differences between the respective fast level estimates; and provide that relatively fast level differences between the left and right hearing devices in a frequency band detected by level estimators with low attack/release time constants are amplified, while relatively slow level differences between the left and right hearing devices in a frequency band detected by level estimators with high attack/release time constants are left unchanged.

2. A binaural hearing system according to claim 1 wherein the left and right hearing devices constitutes or comprises a hearing aid, a headset, an earphone, an ear protection device or a combination thereof.

3. A binaural hearing system according to claim 1 wherein said fast level differences between lower and upper thresholds are amplified, while fast level differences below said lower threshold or above said upper threshold are constant.

4. A binaural hearing system according to claim 3 wherein fast level differences below said lower threshold are left unchanged, and wherein fast level differences above said upper threshold are held at a constant maximum value.

5. A binaural hearing system according to claim 1 wherein each of the left and right hearing devices comprises an input unit for providing respective electric input signals representing sound from the environment at said left and right ears of the user; and an output unit for providing respective output stimuli perceivable by the user and representative of said sound from the environment based on processed versions of said electric input signals.

6. A binaural hearing system according to claim 1 wherein the left and right hearing devices comprises respective left and right level estimators, each comprising said fast level estimator configured to provide a fast level estimate of the electric input signal, and said slow level estimator configured to provide a slow level estimate of the electric input signal, wherein attack and/or release times of said slow level estimator is/are larger than attack and/or release times of said fast level estimator.

7. A binaural hearing system according to claim 1 wherein the binaural level and/or gain estimator comprises a fast binaural level comparison unit configured to receive the fast level estimates of the respective left and right fast level estimators and provide said fast binaural level differences; and a slow binaural level comparison unit configured to receive the slow level estimates of the respective left and right slow level estimators and provide said slow binaural level differences.

8. A binaural hearing system according to claim 1 comprising a resulting level and/or gain estimator or left and right resulting level and/or gain estimation units configured to provide respective resulting left and right level estimates and/or resulting left and right gains, respectively, in dependence of said left and right binaural level and/or gain modification estimates, and respective left and right slow input level estimates of the electric input signals.

9. A binaural hearing system according to claim 1 wherein each of the left and right hearing devices comprises respective antenna and transceiver circuitry to provide that information signals, including said level estimates and/or said gain estimates, and/or said electric input signals, or signals derived therefrom, can be exchanged between the left and right hearing devices and/or between the left and right hearing devices and an auxiliary device.

10. A binaural hearing system according to claim 1 wherein the input units of the left and right hearing devices each comprises a time domain to time-frequency domain conversion unit for providing the respective electric input signals in a time-frequency representation as frequency sub-band signals in a number K of frequency sub-bands.

11. A binaural hearing system according to claim 1 wherein the output units of the left and right hearing devices each comprises a time-frequency domain to time domain conversion unit for converting respective frequency sub-band output signals to an output signal in the time domain.

12. A binaural hearing system according to claim 1 wherein the left and right hearing devices constitutes or comprises a hearing aid, a headset, an earphone, an ear protection device or a combination thereof.

13. A method of estimating a level of left and right electric input signals of left and right hearing devices of a binaural hearing system, the left and right hearing devices being adapted for being worn at or in left and right ears, respectively, of a user, or for being fully or partially implanted in the head at the left and right ears, respectively, of the user, the method comprising receiving fast level estimates from respective left and right fast level estimators with low attack release time constants;

determining fast binaural level differences between the respective fast level estimates; and amplifying the fast level differences between the left and right hearing devices in a frequency band detected by level estimators with low attack/release time constants, while leaving slow level differences between the left and right hearing devices in a frequency band detected by level estimators with high attack/release time constants are unchanged.

* * * * *